US008910562B2

(12) United States Patent
Beaulieu

(10) Patent No.: US 8,910,562 B2
(45) Date of Patent: Dec. 16, 2014

(54) PNEUMATIC SYSTEM FOR CONTROLLING ALUMINUM BATH CRUST BREAKER

(75) Inventor: Gilles Beaulieu, Trois-Rivieres (CA)

(73) Assignee: MAC Valves, Inc., Wixom, MI (US)

( * ) Notice: Subject to any disclaimer, the term of this patent is extended or adjusted under 35 U.S.C. 154(b) by 838 days.

(21) Appl. No.: 13/159,006

(22) Filed: Jun. 13, 2011

(65) Prior Publication Data

US 2012/0312157 A1 Dec. 13, 2012

(51) Int. Cl.
*F15B 13/044* (2006.01)
*F15B 11/08* (2006.01)

(52) U.S. Cl.
CPC ..... *F15B 11/08* (2013.01)
USPC ..... 91/27; 91/28; 91/33; 91/37; 91/448; 60/486

(58) Field of Classification Search
CPC ..... F15B 11/048; F15B 11/068; F15B 11/08; F15B 13/0402; F15B 15/223; F15B 15/2807; C25C 3/14
USPC ..... 91/20, 27, 28, 32, 33, 403, 448, 335, 91/37, 35; 60/486
See application file for complete search history.

(56) References Cited

U.S. PATENT DOCUMENTS 3,400,062 A 9/1968 Bruno et al.
3,620,126 A 11/1971 Fuhrimann
(Continued)

FOREIGN PATENT DOCUMENTS

| | | |
|---|---|---|
| CA | 2675697 | 8/2008 |
| WO | WO2007/042780 | 4/2007 |
| WO | WO2011/060876 | 5/2011 |

OTHER PUBLICATIONS

International Search Report for PCT/US2012/042026 mailed Feb. 26, 2013.

(Continued)

*Primary Examiner* — Ned Landrum
*Assistant Examiner* — Logan Kraft
(74) *Attorney, Agent, or Firm* — Harness, Dickey & Pierce, P.L.C.

(57) ABSTRACT

A pneumatic system controlling a bath crust breaker includes a cylinder defining a piston chamber. A piston is slideably displaced within the cylinder by pressurized fluid directed to either a piston chamber first portion with respect to the piston or a piston chamber second portion oppositely positioned about the piston. A pneumatic valve system includes a first control valve aligned between first control valve first and second positions, the first control valve first position aligned with the first portion, and in the first control valve second position is aligned with the second portion. A second control valve is aligned between second control valve first and second positions. An orifice between a pressure source and first control valve is sized to control fluid flow rate so a pressure reached in either the first or second portion during a crust breaking cycle is less than a pressure source maximum pressure.

25 Claims, 21 Drawing Sheets

(56) References Cited

U.S. PATENT DOCUMENTS

| | | | | |
|---|---|---|---|---|
| 3,660,256 | A | 5/1972 | Lippitt et al. | |
| 4,394,262 | A * | 7/1983 | Bukowski et al. | 210/103 |
| 4,680,930 | A | 7/1987 | Dollison | |
| 4,700,612 | A | 10/1987 | Pfister | |
| 5,542,336 | A | 8/1996 | Larkin | |
| 5,944,045 | A | 8/1999 | Allen et al. | |
| 6,408,740 | B1 | 6/2002 | Holt et al. | |
| 6,436,270 | B1 | 8/2002 | Sander | |
| 6,776,081 | B2 | 8/2004 | Casinge et al. | |
| 7,429,314 | B2 | 9/2008 | Couvreur et al. | |
| 7,892,319 | B2 | 2/2011 | Massaro et al. | |
| 2002/0170819 | A1 | 11/2002 | Horstmann et al. | |
| 2007/0186763 | A1 | 8/2007 | Weiler, Jr. et al. | |
| 2009/0078110 | A1 * | 3/2009 | Waldmann et al. | 91/403 |
| 2009/0308721 | A1 * | 12/2009 | Beaulieu | 200/276 |
| 2012/0292834 | A1 | 11/2012 | Palsson | |

OTHER PUBLICATIONS

Written Opinion of the International Searching Authority for PCT/US2012/042026 mailed Feb. 26, 2013.

Verreault, J., et al., "Retrofit of a Combined Breaker Feeder with a Chisel Bath Contact Detection System to Reduce Anode Effect Frequency in a Potroom." in: Light Metals 2011 (Edited by: Stephen J. Lindsay) TMS (The Minerals, Metals & Materials Society), 2011, pp. 467-470.

International Search Report for International Application No. PCT/US2012/042035 mailed Jan. 25, 2013.

Written Opinion of the International Searching Authority for International Application No. PCT/US2012/042035 mailed Jan. 25, 2013.

* cited by examiner

PNEUMATIC SYSTEM FOR CONTROLLING ALUMINUM BATH CRUST BREAKER

FIELD

The present disclosure relates to pneumatic control systems for operating metal including aluminum processing baths.

BACKGROUND

This section provides background information related to the present disclosure which is not necessarily prior art.

Known systems used to control operations of melt baths such as aluminum processing baths can include pneumatic valves and piping used to drive a crust breaking tool to create an aperture by breaking through the hardened upper crust layer formed on the bath. The crust breaking tool is intended to open the aperture to permit addition of additional alumina material to the molten bath of aluminum. When creation of the aperture has been confirmed, pressurized air directs the crust breaking tool to retract from the crust layer. The drawbacks of such systems include the large volumes of pressurized which are used to control a normal crust breaking operation, and particularly when crust material forms on the crust breaking tool such that bath detection cannot occur, and/or when the crust breaking tool cannot penetrate the crust layer.

In these situations, the crust breaking tool can remain in the bath for an undesirable length of time which can damage the crust breaking tool, or render the detection system inoperative. Also in these situations, the subsequent feeding of new alumina material into the bath can be hindered, or the system may be unable to identify how many feed events have occurred, thus leading to out-of-range conditions in the bath. A further drawback of known control systems is the large volume of high pressure air required significantly increases operating costs of the system due to the size and volume of high pressure air system requirements, the operating time of pumps/compressors, and the number of air compressors and air dryers required for operation.

SUMMARY

This section provides a general summary of the disclosure, and is not a comprehensive disclosure of its full scope or all of its features.

According to several embodiments a pneumatic system for controlling a bath crust breaker includes a cylinder defining a piston chamber. A piston is slideably displaced within the cylinder by a pressurized fluid directed to either a first portion of the piston chamber with respect to the piston or a second portion of the piston chamber oppositely positioned about the piston with respect to the first portion. A pneumatic valve system includes a first control valve aligned between first control valve first and second positions. The first control valve in the first control valve first position is aligned with the first portion, and in the first control valve second position is aligned with the second portion. A second control valve is aligned between second control valve first and second positions.

According to other embodiments, a pneumatic system for controlling a bath crust breaker includes a cylinder defining a piston chamber. A piston is slideably displaced within the cylinder by a pressurized fluid. A crust breaker rod connected to the piston is displaced into a bath by displacement of the piston. A pneumatic valve system includes a first control valve moved between first control valve first and second positions. The first control valve in the first control valve first position is aligned to pressurize a first portion of the piston chamber, and in the first control valve second position is aligned to pressurize a second portion of the piston chamber. An orifice positioned between a pressure source and the first control valve is sized to control a pressurized fluid flow rate per unit time such that a pressure reached in either the first or second portion during a crust breaking cycle is less than a maximum pressure of the pressure source.

According to further embodiments, a pneumatic system for controlling a bath crust breaker includes a cylinder defining a piston chamber. A piston is slideably displaced within the cylinder by a pressurized fluid from a pressure source directed to either a first portion of the piston chamber with respect to the piston or a second portion of the piston chamber oppositely positioned about the piston with respect to the first portion. Means for crust breaking are connected to the piston and displaced into a bath when the piston is displaced in the cylinder in a piston drive direction. Means are provided for directing the pressurized fluid into either the first or second portion of the piston chamber. Means are provided for limiting a pressure within the first and second portions of the piston chamber to less than a maximum pressure of the pressure source.

According to additional embodiments, a method for controlling a bath crust breaker pneumatic system comprises: aligning the first control valve to the first control valve second position to pressurize the second portion of the piston chamber; slideably displacing the piston together with the crust breaker rod until the crust breaker rod enters a bath; and sizing a first orifice positioned between a first portion directed pressure source and the first control valve to control a pressurized fluid flow rate per unit time such that a pressure reached in either the first or second portion during a crust breaking cycle is less than a maximum pressure of the pressure source.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings. For simplification, not all parts are shown in all views of the drawings.

DETAILED DESCRIPTION

Example embodiments will now be described more fully with reference to the accompanying drawings.

Figure 1:
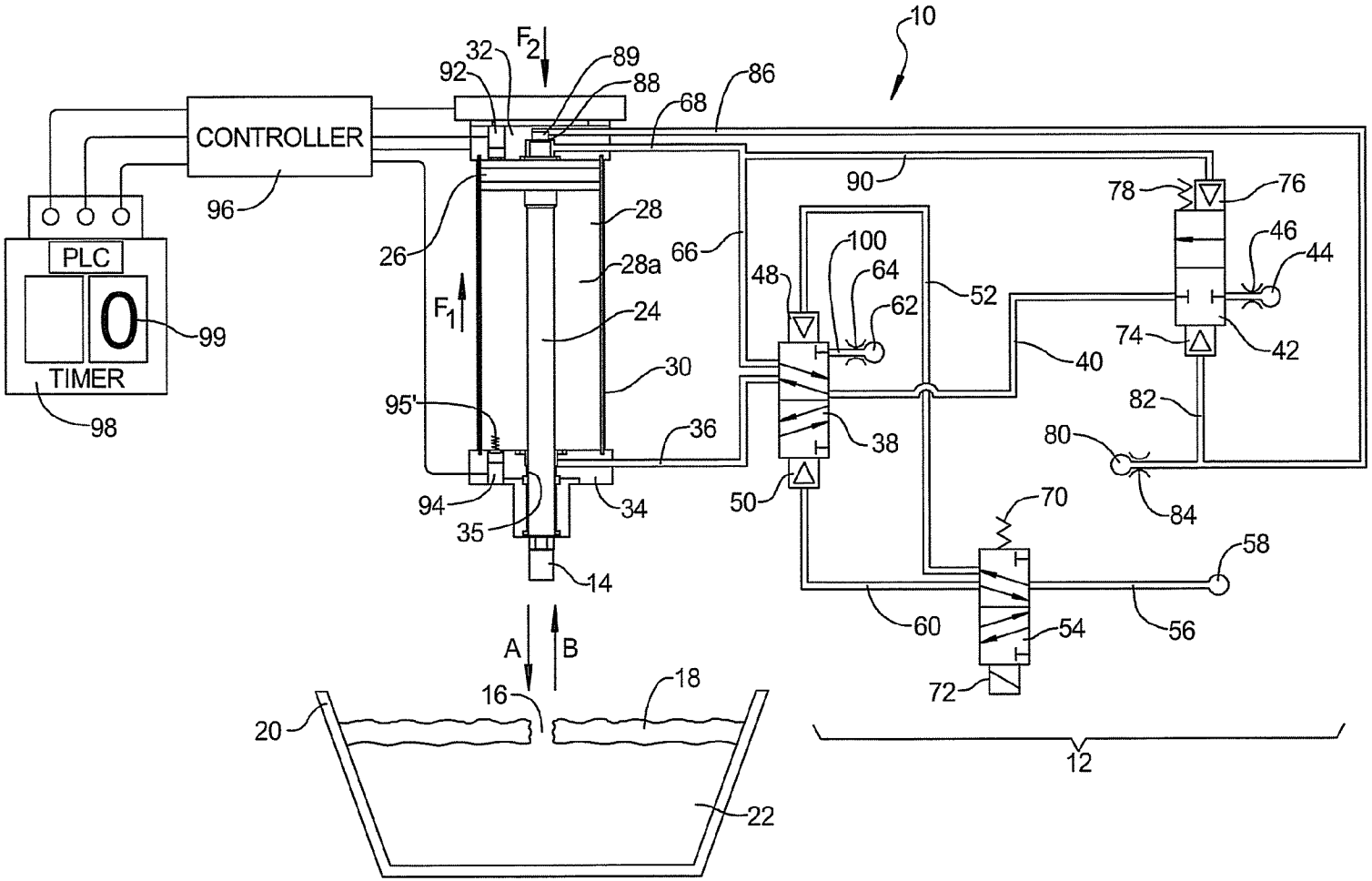
FIG. 1 is a diagram for a pneumatic system for controlling a bath crust breaker of the present disclosure aligned prior to initiation of a crust breaking operation.

Referring to FIG. 1, a pneumatic operating system 10 used for example for production of aluminum includes pneumatic valve system 12 which directs displacement of a crust breaker rod 14 which is axially extended through an aperture 16 of a crust layer 18 formed in an aluminum bath chamber 20 during processing of an melt bath 22. Crust breaker rod 14 which may include a chisel or other crust breaking tool is connected to a first end of a piston rod 24 which has a piston 26 connected at an opposite second end. According to other embodiments, crust breaker rod 14 is an integral portion of piston rod 24, therefore piston rod 24 directly contacts melt bath 22. Piston 26 is slideably disposed in a piston chamber 28 of a cylinder 30 allowing piston 26 to slide in either of a piston drive direction "A" or a piston return direction "B". As piston 26 moves in either of the piston drive direction "A" or the piston return direction "B", the total travel path of piston 26 is limited by piston contact with either a first cylinder head 32 or an opposite second cylinder head 34. Second cylinder head 34 includes a bearing/seal 35 creating a pressure containing boundary for piston rod 24 and piston chamber 28.

At a top or piston first stop position shown, piston 26 is held in position by pressurized air in piston chamber 28 which is provided through a connection at second cylinder head 34 via a first air supply/vent line 36 directing pressurized air beneath piston 26, creating a force $F_1$ directing piston 26 in the piston return direction "B". Pressurized fluid such as air is supplied to first air supply/vent line 36 by a pneumatically positioned first control valve 38. When piston 26 is at the piston first stop position, first control valve 38 in a first control valve first position is aligned to trap pressurized air in a first portion **28*a* of piston chamber 28 defined as the partial volume of piston chamber 28 below piston 26. In the first control valve first position, first control valve 38 also aligned with first air supply/vent line 36, first control valve 38, and a first air pressure line 40**.

A pneumatically controlled and biased second control valve 42 in a second control valve first position is aligned to isolate first air pressure line 40 from a first portion directed first pressure source 44. Approximately 8 psi air pressure is trapped in first air supply/vent line 36 and below piston 26 in first portion **28*a* at the piston first contact position. By normally isolating first portion 28*a* of piston chamber 28 from the first pressure source 44, the trapped air path retains a volume of air to hold piston 26 in the piston first stop position while also preventing first portion 28*a* from filling to the full pressure available from first pressure source 44, thereby reducing air usage of pneumatic operating system 10. A first orifice 46 is positioned between first pressure source 44 and second control valve 42 to throttle air flow to first portion 28*a*. By selecting a timing for opening and/or closing operation of first and second control valves 38, 42 the second control valve 42 can be repositioned to isolate first pressure source 44 before first portion 28*a*** pressure exceeds a predetermined minimum piston displacement/hold pressure, which according to several embodiments is approximately 8 psi. Other minimum piston displacement/hold pressures can also be selected by controlling valve opening/closing times, increasing or decreasing orifice size, modifying system piping/tubing sizes and the like.

First control valve 38 is positioned using air pressure delivered to either one of a first or second control valve port 48, 50 of first control valve 38. At the piston first stop position and the first control valve first position, first control valve port 48 receives pressurized air delivered via a first valve positioning line 52 through a solenoid operated valve 54 which is aligned to receive pressurized air via a source air supply line 56 from a first control valve directed second pressure source 58. Also at the piston first stop position and the first control valve first position, second control valve port 50 is vented to atmosphere via a second valve positioning line 60 through solenoid operated valve 54. Still further at the piston first stop position and the first control valve first position, first control valve 38 is aligned to prevent flow of pressurized air from a second portion directed third pressure source 62 via a second orifice 64 positioned in a source air supply line 100 through a air delivery/vent line 66 and a second air supply/vent line 68 to piston chamber 28.

Solenoid operated valve 54 is normally biased to a solenoid operated valve first position shown by a biasing member 70, such as a compression spring provided with solenoid operated valve 54. At the piston first contact position of piston 26, second air supply/vent line 68, which is directed through first cylinder head 32 into piston chamber 28 above piston 26, is vented to atmosphere via 66 and first control valve 38. By maximizing the port sizes of first control valve 38, cylinder venting can be accomplished in approximately 1 second or less. Solenoid operated valve 54 also includes a solenoid 72 which when energized repositions the internal flow paths of solenoid operated valve 54 to a solenoid operated valve second position which is shown and described in FIG. 2. Solenoid 72 when energized provides a solenoid force greater than the biasing force of biasing member 70.

Similar to first control valve 38, second control valve 42 includes opposed first and second control valve ports 74, 76. Second control valve 42 also includes a biasing member 78. Biasing member 78 provides additional force to reposition second control valve 42 at a second control valve first position against the force of pressurized air from a piston rod and second control valve directed fourth pressure source 80. Fourth pressure source 80 is in communication with first control valve port 74 using a control valve first pressure line 82. A third orifice 84 is in the flow path of first pressure line 82 to restrict pressurized air flow also through a pressure transfer line 86 which is connected through first cylinder head 32 to a rod cavity 88.

At the piston first stop position, a piston rod extending member 89 is received in rod cavity 88. A surface area of piston rod extending member 89 is smaller than a surface area of piston 26, therefore force $F_1$ is greater than a force $F_2$ of pressurized fluid acting on piston rod extending member 89. Piston rod extending member 89 in rod cavity 88 also blocks a fluid path from pressure transfer line 86 to a control valve second pressure line 90 connected to second control valve port 76 of second control valve 42. Pressurized air from fourth pressure source 80 acting through first control valve port 74 can therefore hold the second control valve first position of second control valve 42.

Pneumatic operating system 10 further includes first and second electrical contact devices 92, 94 which are individually connected to one of first and second cylinder heads 32, 34 respectively. Each of the first and second electrical contact devices 92, 94 include a conductive biasing member 95 extending into piston chamber 28. Contact between piston 26 and biasing member 95 of first electrical contact device 92 completes a circuit with a logic circuit, a computer, and/or a device such as a controller, together collectively referred to herein as controller 96. Controller 96 is used to generate signals for example to energize or de-energize solenoid 72. Controller 96 is also in communication with a timer 98 which permits a predetermined time period to be established for execution of a complete crust breaking cycle. Timer 98 can be separate from or included with controller 96. An indicator symbol 99 can be provided to visually indicate to an operator/observer a period of time remaining for completion of the crust breaking cycle.

With continued reference to FIG. 1, each of the first, second and third orifices 46, 64, 84 are sized to limit a flow rate per unit time from first, third or fourth pressure sources 44, 62, 80 directed to either first or second portions 28*a*, 28*b*, such that by pre-setting a total length of the period of time of the crust breaking cycle, a time period either of first or second control valves 38, 42 are aligned with first or second portions 28*a*, 28*b* is less than a time period required for the full pressure of first, third or fourth pressure sources 44, 62, 80 to be reached in either first or second portions 28*a*, 28*b*. For example, when a maximum pressure of 100 psi is available in any of first, third or fourth pressure sources 44, 62, 80, a crust breaking cycle time period of approximately 4 seconds is used herein to size first, second and third orifices 46, 64, 84 such that a pressure in either first or second portion 28*a*, 28*b* of piston chamber 28 is approximately 8 psi when air pressure is isolated from first, third or fourth pressure sources 44, 62, 80. Different time periods, different orifice sizes, and/or different pressure source pressures can be used to determine the desired pressure retained in first or second portions 28*a*, 28*b*. One advantage of sizing the first, second and third orifices 46, 64, 84 in this way is to reduce the volume of pressurized air used to displace piston 26 during normal crust breaking operation.

Figure 2:
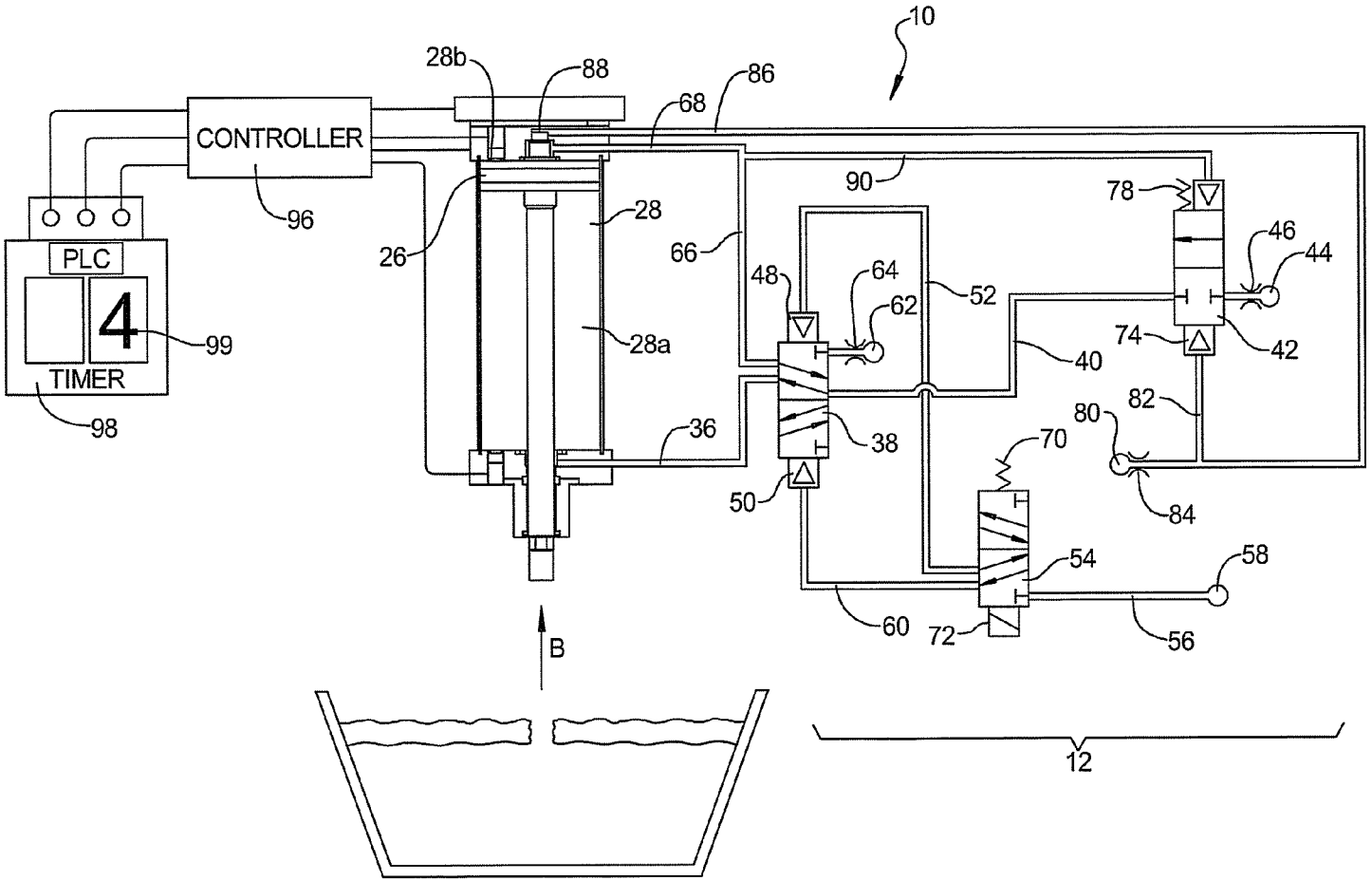
FIG. 2 is a diagram modified from FIG. 1 to show the pneumatic system alignment upon initializing a crust breaking operation.

Referring to FIG. 2, immediately upon initiation of a crust breaking cycle which displaces crust breaker rod 14 toward crust layer 18, controller 96 sets timer 98 to a predetermined period of time defining a cycle length which according to several embodiments is approximately 4 seconds. Timer 98 thereafter begins to count down to zero seconds. The cycle length remaining at any portion of the crust breaking cycle is displayed by an indicator symbol 99. Controller 96 simultaneously directs energizing of solenoid 72 to reposition the internal valve member of solenoid operated valve 54 to a solenoid operated valve second position as shown, overcoming the biasing force of biasing member 70. In the solenoid operated valve second position, solenoid operated valve 54 redirects pressurized air from second pressure source 58 via source air supply line 56, solenoid operated valve 54 and second valve positioning line 60 into second control valve port 50 of first control valve 38.

Air pressure introduced into second control valve port 50 displaces the valve member of first control valve 38, thereby defining a first control valve second position. The first control valve second position also repositions the flow path of first control valve port 48 and first valve positioning line 52 to vent first control valve port 48 to atmosphere. Repositioning first control valve 38 to the first control valve second position directs pressurized air from third pressure source 62 into air delivery/vent line 66 and into second air supply/vent line 68 to pressurize rod cavity 88 and a second portion 28*b* of piston chamber 28. First air supply/vent line 36 is simultaneously aligned to vent to atmosphere through first control valve 38, thereby venting first portion 28*a* of piston chamber 28 to approximately zero (0) psi. Increasing pressure in second portion 28*b* displaces piston 26 in the piston drive direction "A".

Figure 3:
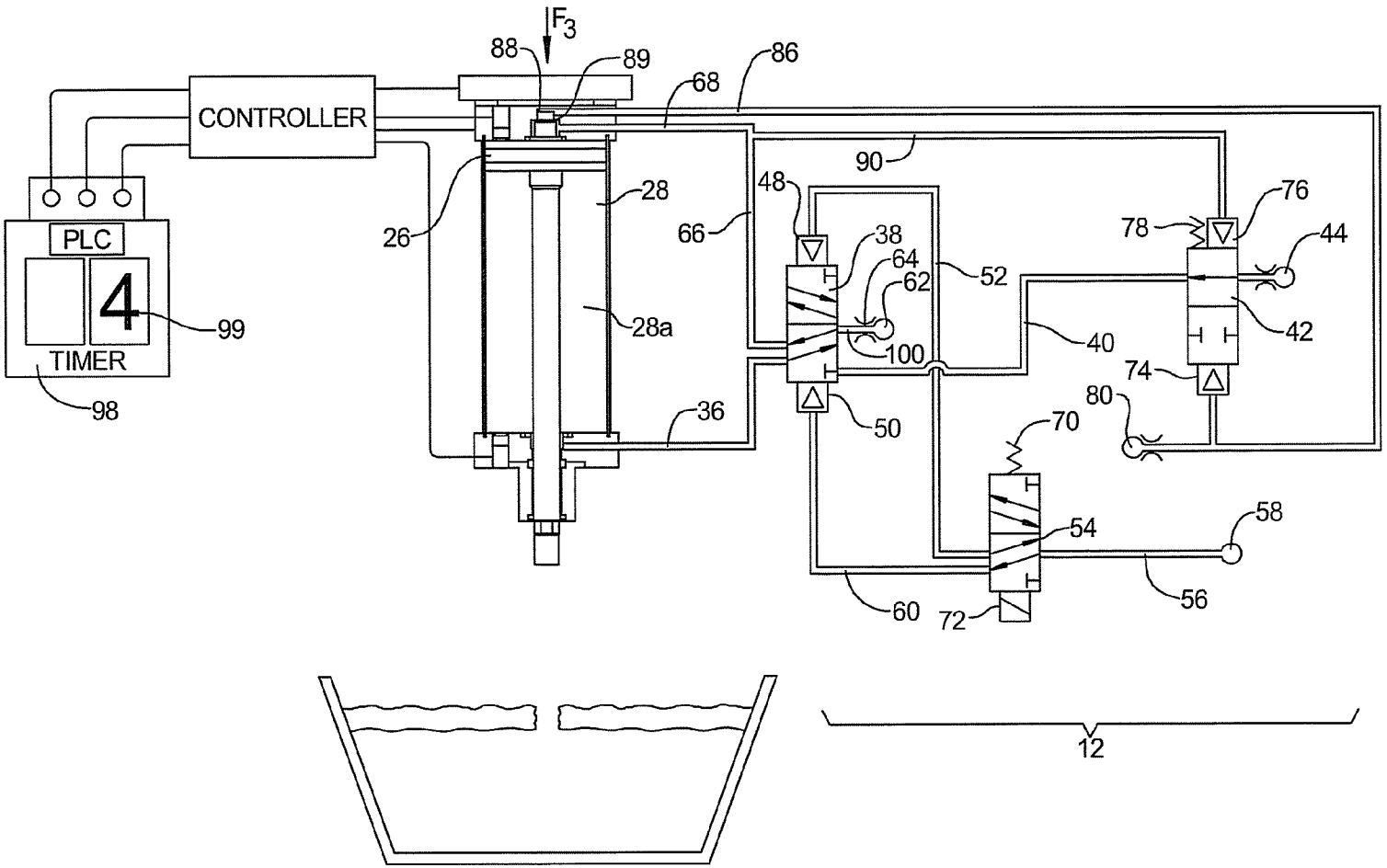
FIG. 3 is a diagram modified from FIG. 2 to show the pneumatic system pressure distribution after initializing the crust breaking operation.

Referring to FIG. 3 and again to FIG. 1, pressurized air from third pressure source 62 acts on piston rod extending member 89 positioned in rod cavity 88, creating a force $F_3$. Force $F_3$ is a sum of force $F_2$ plus the additional force from pressurized air from third pressure source 62 acting on the surface area of piston rod extending member 89. Second orifice 64 limits air flow from third pressure source 62, and third orifice 84 limits air flow from fourth pressure source 80 over a first portion of the crust breaker cycle such that pressure increases in second portion 28*b* of piston chamber 28 only to, for example, approximately eight (8) psi. Force $F_3$ is therefore also a product of the air pressure (in the example provided, approximately 8 psi) multiplied by an area of piston 26. Force $F_3$ displaces piston 26 in the piston drive direction "A". As pressurized air from third pressure source 62 is received in rod cavity 88, control valve second pressure line 90 also pressurizes, and this pressure together with the biasing force of biasing member 78 repositions the valve member of second control valve 42 defining a second control valve second position, which aligns first pressure source 44 with first air pressure line 40. When first control valve 38 is aligned at the first control valve second position, pressurized air in first air pressure line 40 is isolated from first portion 28*a* of piston chamber 28.

Figure 4:
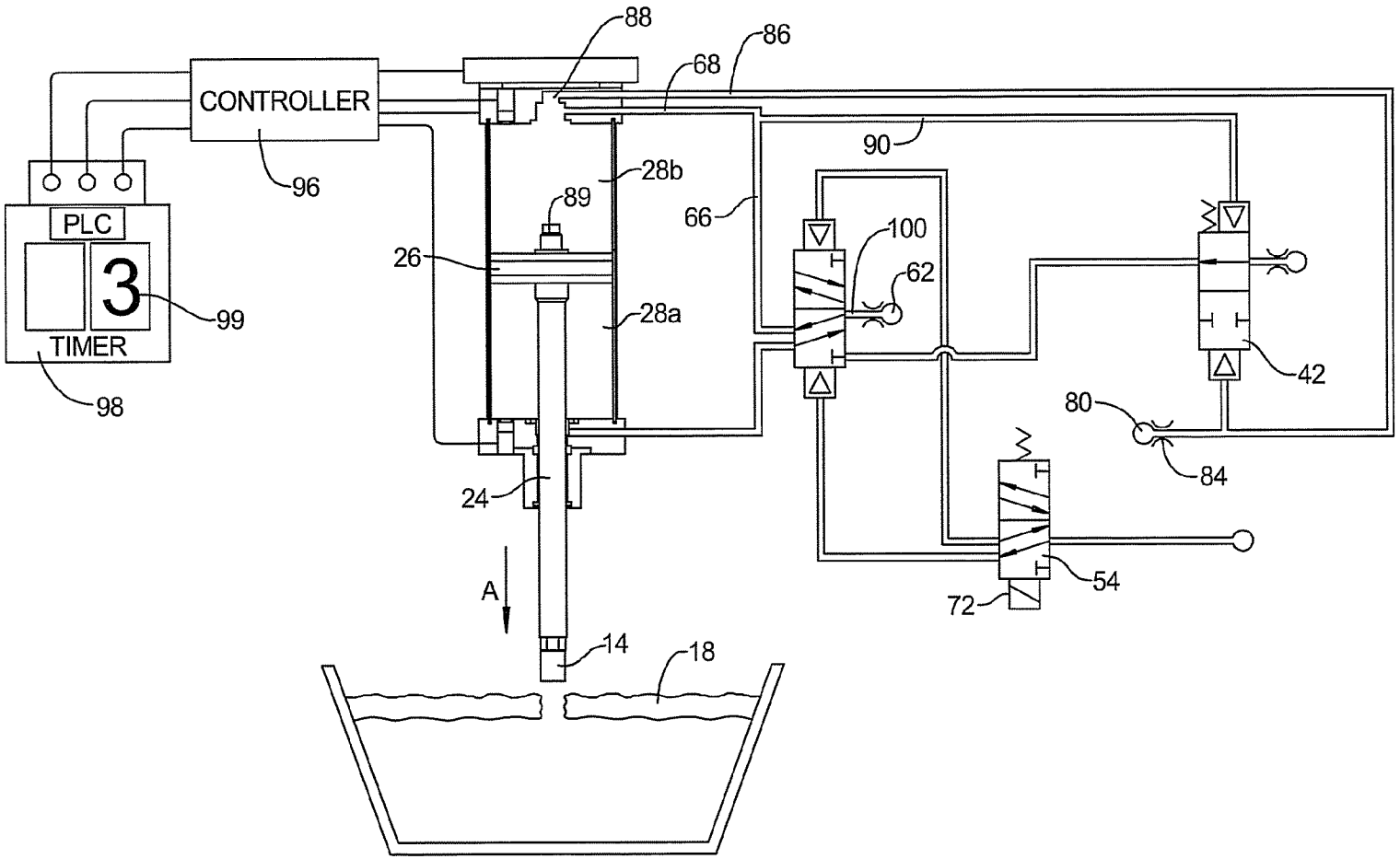
FIG. 4 is a diagram modified from FIG. 3 to show the crust breaker rod immediately prior to encountering a crust layer.

Referring to FIG. 4, continued flow of pressurized air from third pressure source 62 via second air supply/vent line 68 and from fourth pressure source 80 via pressure transfer line 86 displaces piston 26 in the piston drive direction "A" into contact with crust layer 18. Pressure in second portion 28*b* remains at, for example, approximately 8 psi. Controller 96 continues to maintain current flow to energized solenoid 72 of solenoid operated valve 54. Indicator symbol 99 displays the numeral 3, indicating that approximately one second has elapsed from the start of the crust breaking operation cycle to the point of contact between crust breaker rod 14 and crust layer 18.

Figure 5:
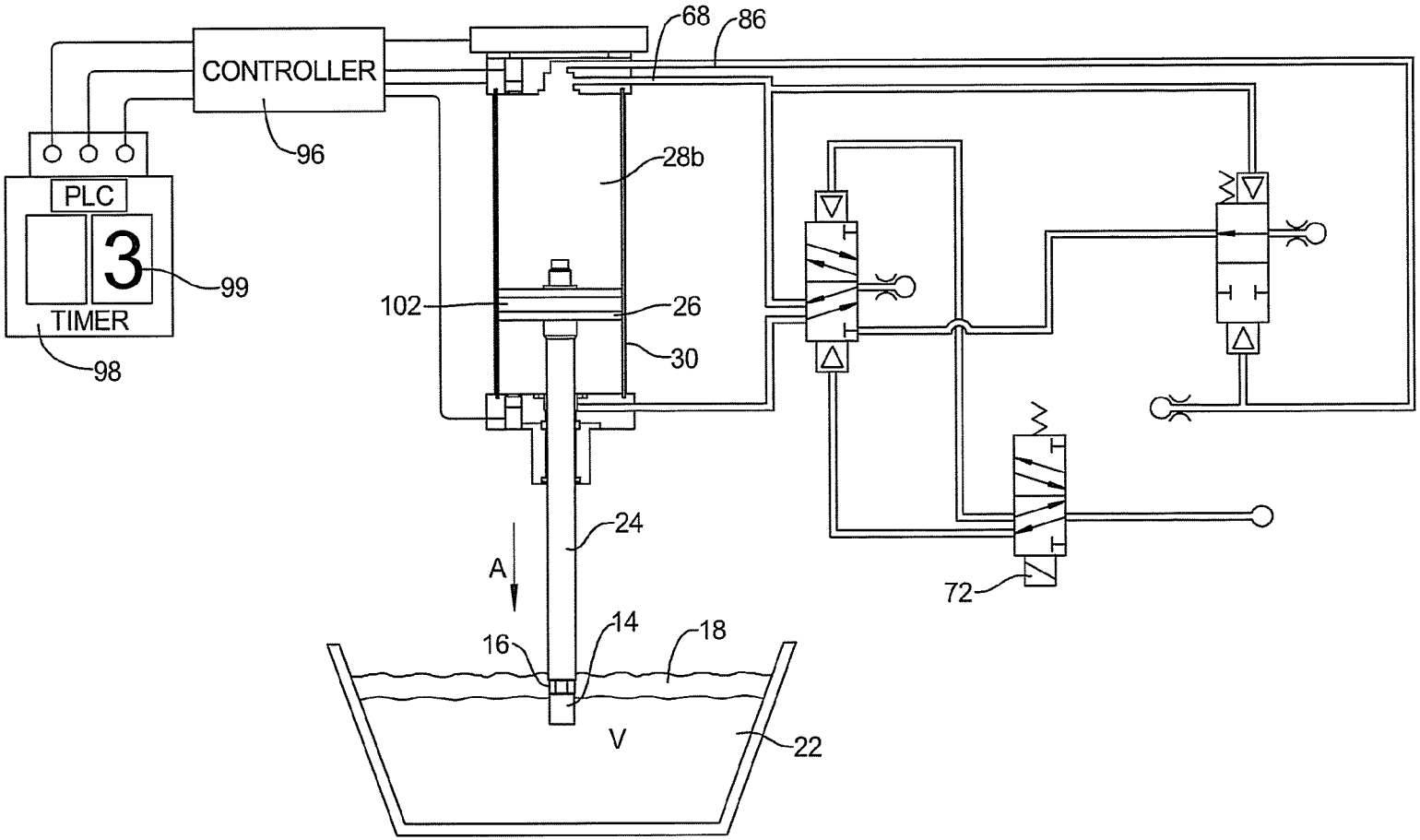
FIG. 5 is a diagram modified from FIG. 4 to show a bath voltage detection position of the crust breaker rod.

Referring to FIG. 5, when crust breaker rod 14 creates or otherwise penetrates aperture 16 through crust layer 18 and subsequently enters melt bath 22, a bath voltage V (for example as a cathode voltage) is conducted via a circuit that can include, but is not limited to conductive crust breaker rod 14, conductive piston rod 24, conductive piston 26, a conductive piston seal 102 in the form of a pressure seal ring, conductive cylinder 30 and controller 96. When bath voltage V is identified in controller 96, a signal is sent to de-energize solenoid 72. A system anode voltage can also be provided to controller 96.

Referring to FIG. 6 and again to FIGS. 1-5, when solenoid 72 is de-energized, the biasing force of biasing member 70 realigns the inner valve member of solenoid operated valve 54 such that air pressure from second pressure source 58 is once again aligned with first control valve port 48 of first control valve 38, and second control valve port 50 is vented to atmosphere. This event occurs with approximately 3 seconds indicated by indicator symbol 99 and remaining in the crust breaking cycle in the example provided.

Figure 6:
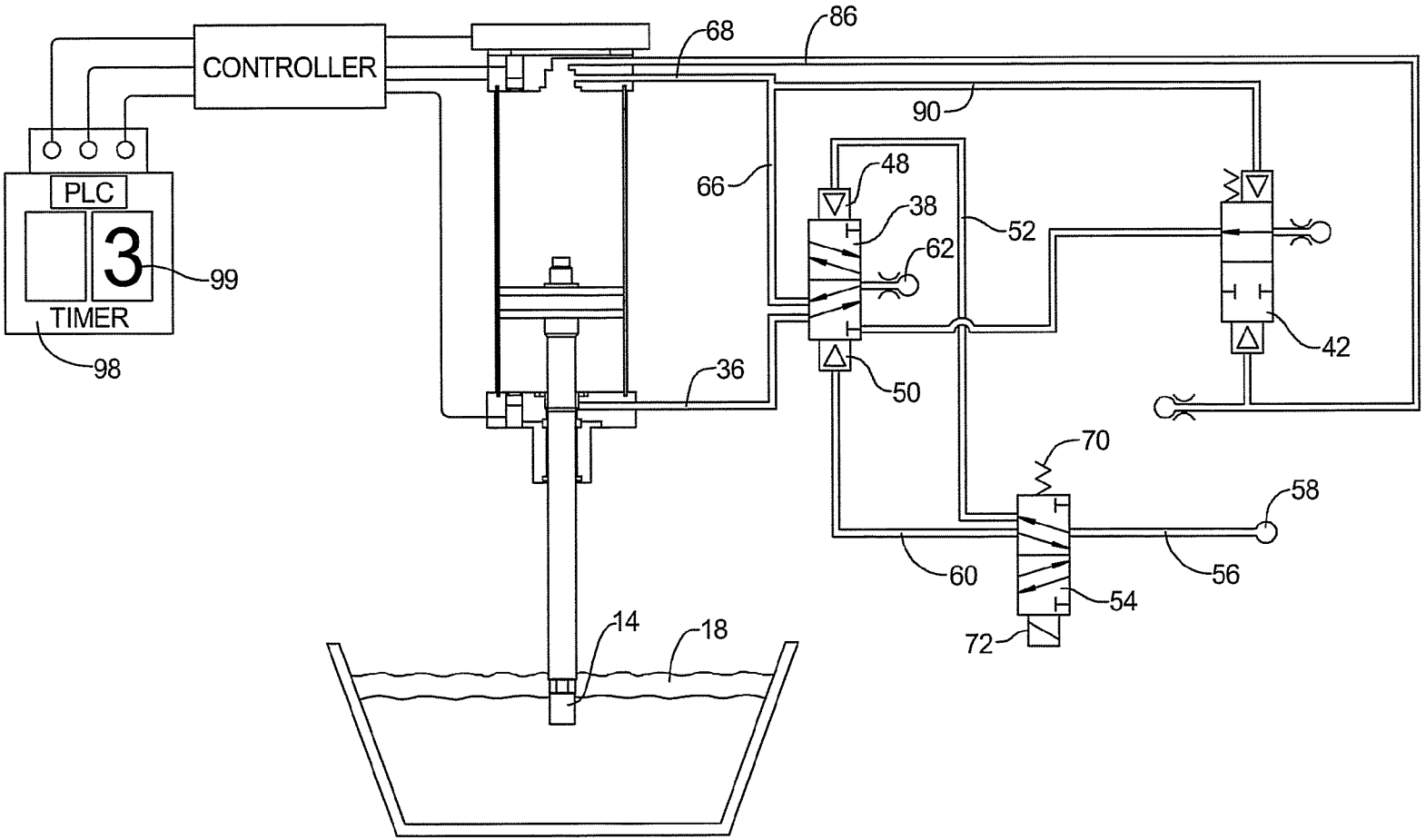
FIG. 6 is a diagram modified from FIG. 5 to show realignment of system control valves following bath voltage detection.
Figure 7:
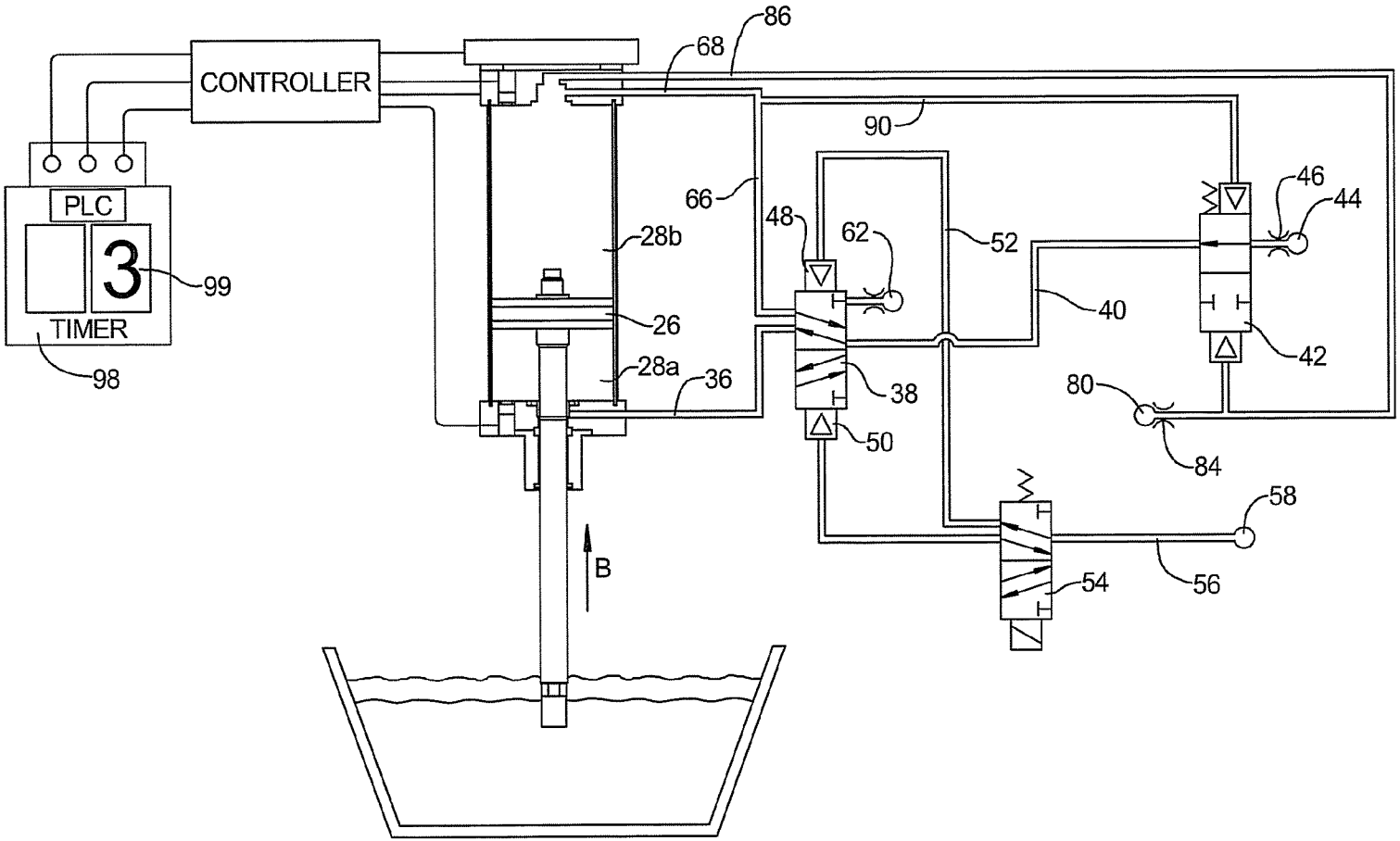
FIG. 7 is a diagram modified from FIG. 6 to show the pneumatic system pressure distribution after completion of the crust breaker and bath detection operation and prior to completion of a predetermined time period.

Referring to FIG. 7 and again to FIG. 6, pressurized air from second pressure source 58 realigns the valve member of first control valve 38, which redirects pressurized air from first pressure source 44 through the previously identified flow path to first portion 28*a* of piston chamber 28. Simultaneously, second portion 28*b* is aligned to vent to atmosphere through first control valve 38. Controlled air flow through first orifice 46 provides, for example, approximately 8 psi pressure in first portion 28*a* to begin to displace piston 26 in the piston return direction "B".

Figure 8:
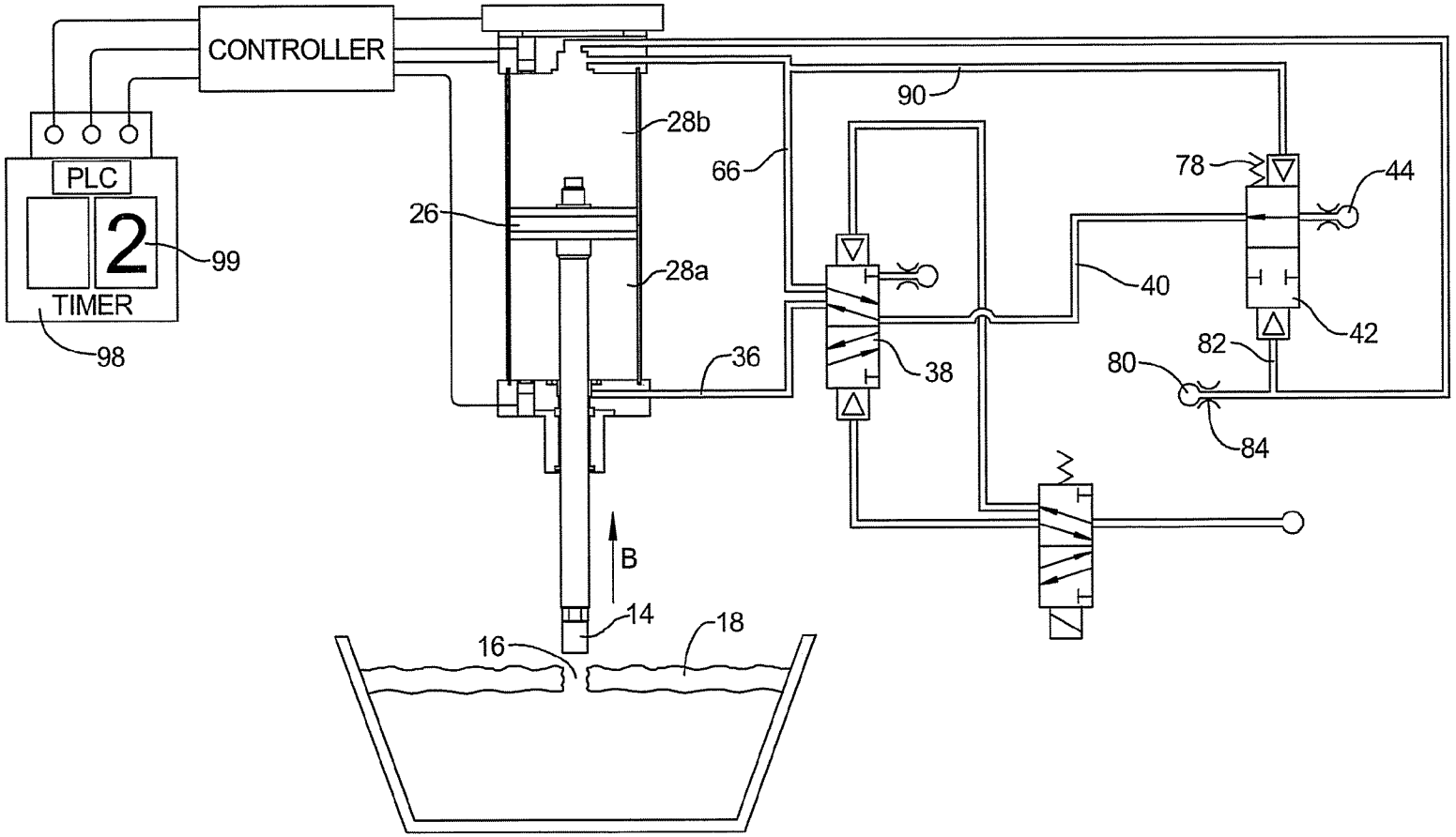
FIG. 8 is a diagram modified from FIG. 7 to show system conditions during return of the piston toward the piston first stop position.

Referring to FIG. 8 and again to FIGS. 3-7, air delivery/vent line 66 is vented to atmosphere, however the rising motion of piston 26 increases pressure in control valve second pressure line 90. The backpressure plus the biasing force of biasing member 70 can therefore retain the position of second control valve 42 by overcoming the air pressure at control valve first pressure line 82 from fourth pressure source 80. Pressurized air from first pressure source 44 therefore continues to flow into first portion 28*a*. As crust breaker rod 14 lifts away from crust layer 18, approximately 2 seconds remain of the crust breaking cycle as displayed by indicator symbol 99.

Figure 9:
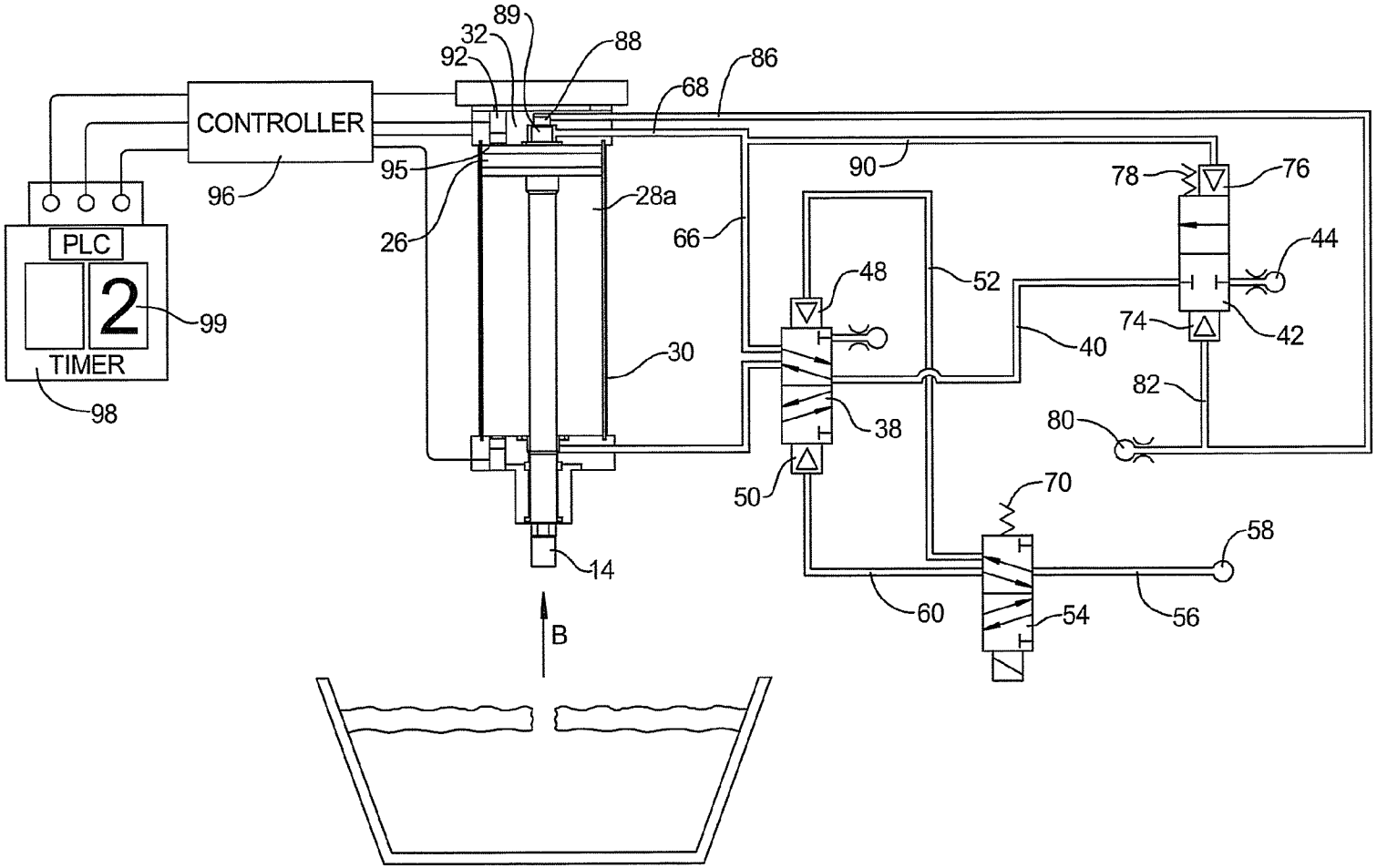
FIG. 9 is a diagram modified from FIG. 8 to show system conditions when the piston has returned to the piston first stop position.

Referring to FIG. 9, with approximately 2 seconds still remaining of the crust breaking cycle, piston 26 contacts the conductive biasing member 95 of first electrical contact device 92, thereby closing a circuit which signals to controller 96 the return of piston 26. Piston 26 can continue to travel in the piston return direction "B" until piston 26 contacts first cylinder head 32 at the piston first contact position. At this time, piston rod extending member 89 has re-entered rod cavity 88 and closes a path between pressure transfer line 86 (pressurized by fourth pressure source 80) and control valve second pressure line 90. Air delivery/vent line 66 is vented to atmosphere and control valve second pressure line 90 is connected to air delivery/vent line 66, therefore control valve second pressure line 90 is vented completely to atmosphere. Pressurized air in fourth pressure source 80 acting through control valve first pressure line 82 overcomes the biasing force of control valve biasing member 78, and second control valve 42 realigns such that first pressure source 44 is once again isolated from first air pressure line 40 and therefore from first portion 28*a* of piston chamber 28. Timer 98 counts down to zero and the piston first contact position is retained until a next crust breaking cycle is initiated.

Figure 10:
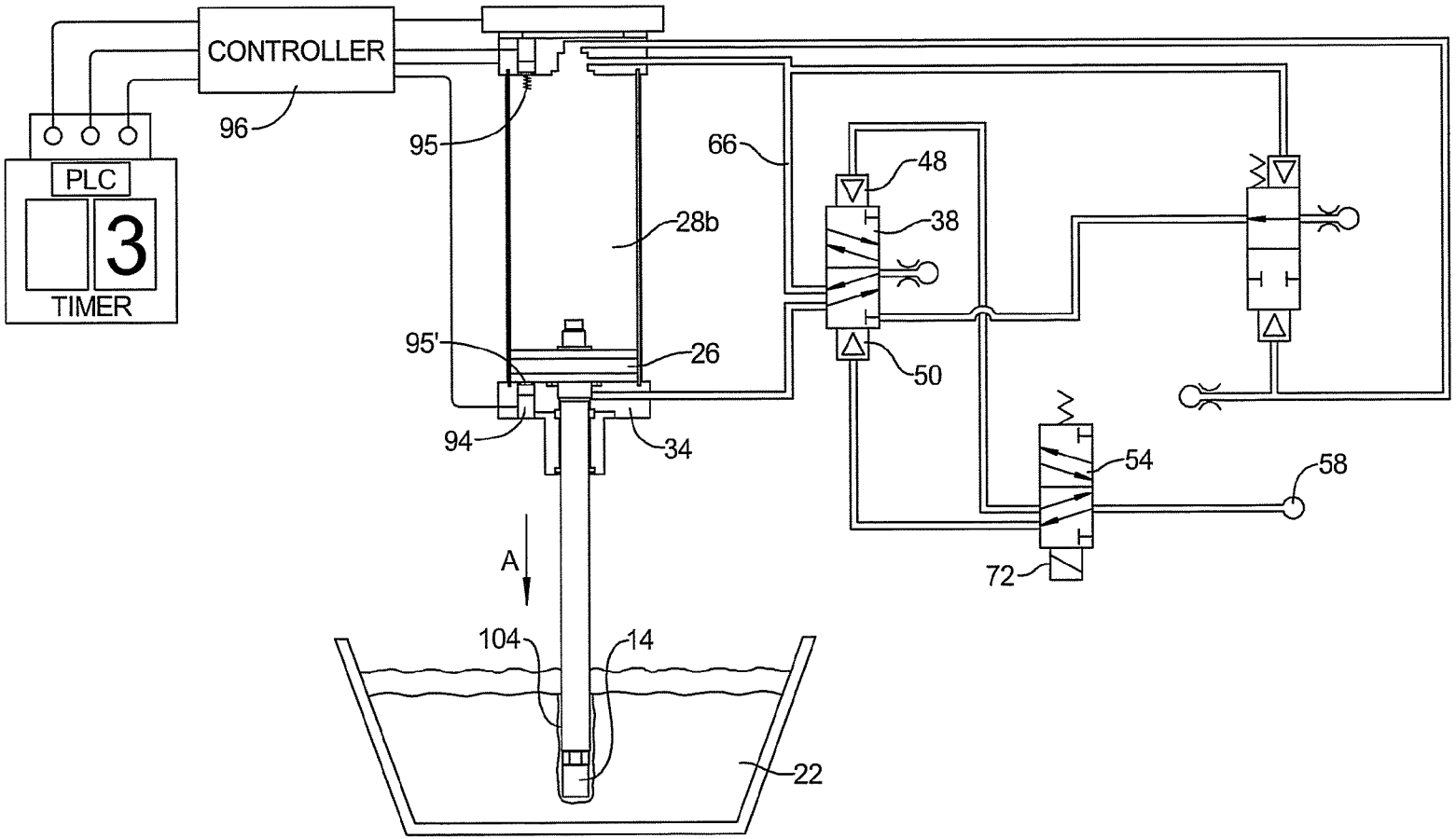
FIG. 10 is a diagram modified from FIG. 6 to show piston and crust breaker bar positions during a no bath detection operating condition.

Referring to FIG. 10 and again to FIGS. 1 and 5, if bath voltage V is not detected and identified at controller 96 when contact between crust breaker rod 14 and melt bath 22 occurs, air pressure in second portion 28*b* of piston chamber 28 continues to displace piston 26 in the piston drive direction "B" until piston 26 contacts biasing member 95 of second electrical contact device 94 and subsequently contacts second cylinder head 34, creating the piston second stop position. A failure to detect the melt bath 22 can result from excess slag or coating material 104 such as crust material covering crust breaker rod 14 from previous crust breaking operations preventing conduction of bath voltage V. To minimize the volume of pressurized air that would subsequently enter second portion 28*b* from third pressure source 62, which can contain pressurized air according to several embodiments of approximately 100 psi, contact of biasing member 95 by piston 26 closes an electrical circuit with controller 96. A signal is generated for example by controller 96 to de-energize solenoid 72 of solenoid operated valve 54. This will realign solenoid operated valve 54 to pressurize first control valve port 48 of first control valve 38 and de-pressurize second control valve port 50.

Figure 11:
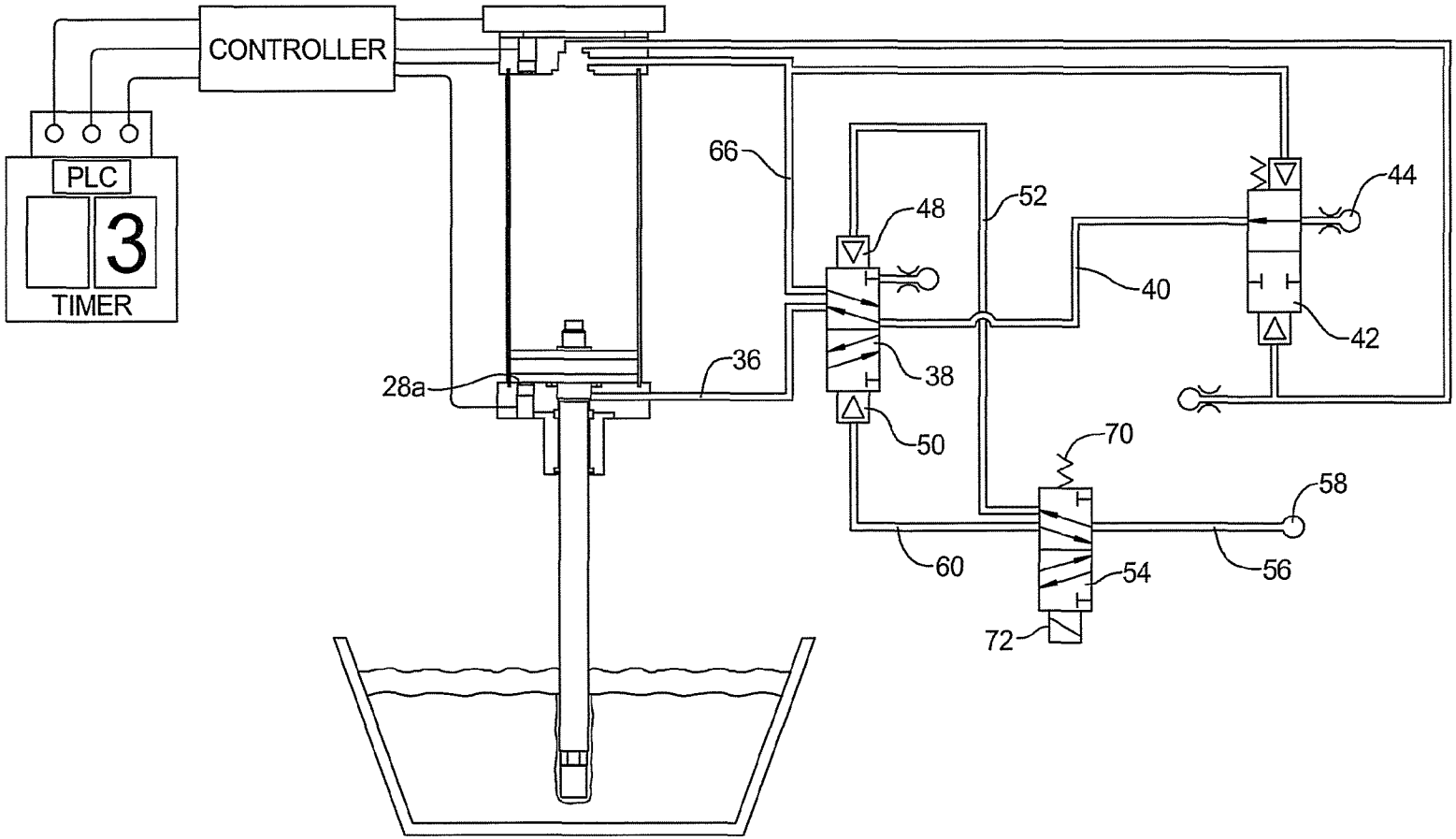
FIG. 11 is a diagram modified from FIG. 10 to show realignment of system control valves following system indication of the no bath detection condition.

Referring to FIG. 11, when solenoid 72 de-energizes, the biasing force of biasing member 70 realigns solenoid operated valve 54 to redirect pressurized air from second pressure source 58 via first valve positioning line 52 to first control valve port 48. Second control valve port 50 is aligned to vent to atmosphere through second valve positioning line 60. First control valve 38 realigns such that pressurized air from first pressure source 44 is directed through first air pressure line 40 to first air supply/vent line 36 and into first portion 28*a* of piston chamber 28. Air delivery/vent line 66 is vented to atmosphere via first control valve 38 to vent second portion 28*b* of piston chamber 28 to atmosphere.

Figure 12:
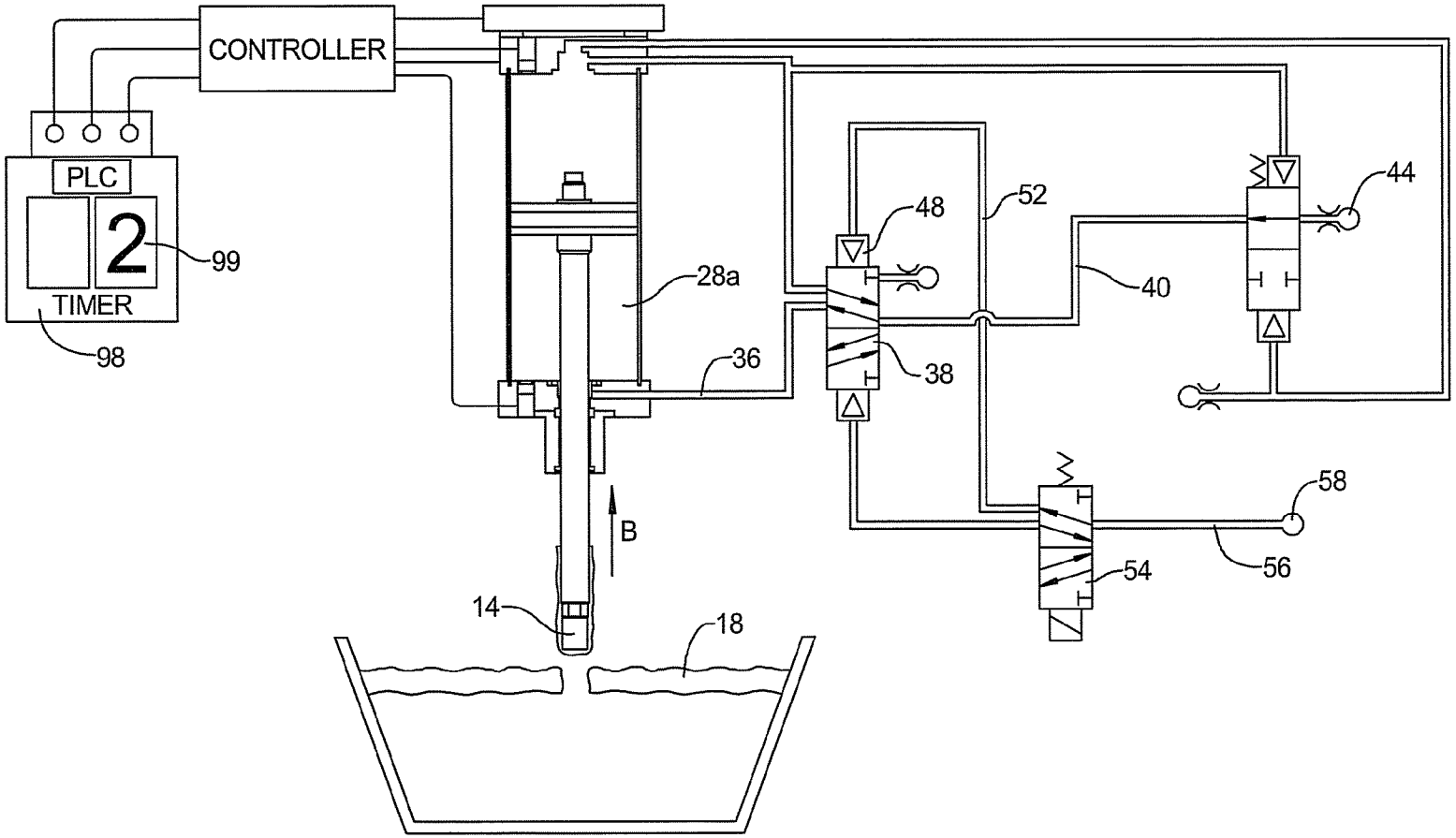
FIG. 12 is a diagram modified from FIG. 11 to show system conditions during return of the piston toward the piston first stop position in the no bath detection condition.

Referring to FIG. 12, pressurized air in first portion 28*a* displaces piston 26 in the piston return direction "B". In the example provided, approximately 2 seconds remain of the crust breaking operation as displayed by indicator symbol 99.

Figure 13:
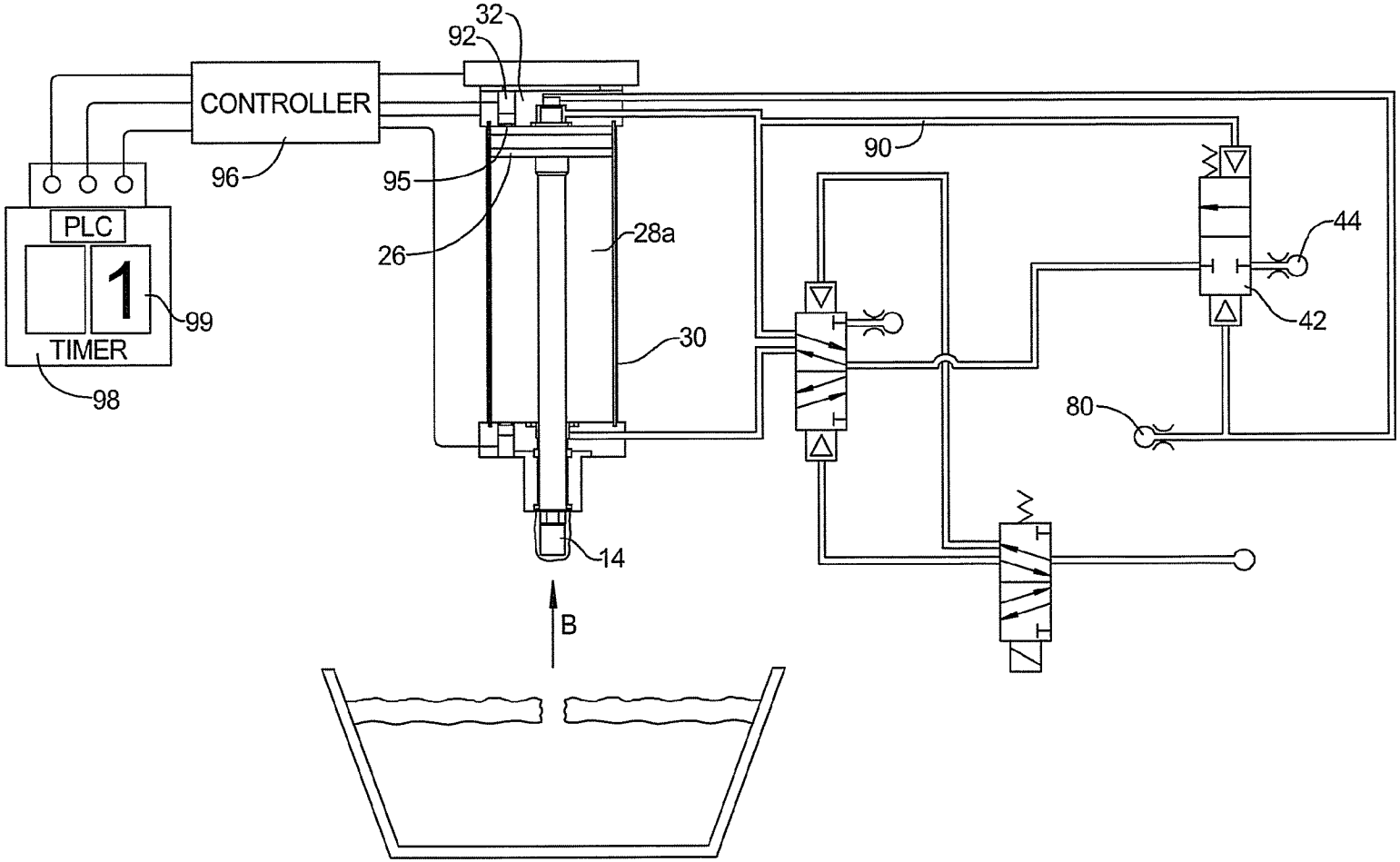
FIG. 13 is a diagram modified from FIG. 12 to show system conditions at the completion of the no bath detection condition cycle.

Referring to FIG. 13, with, for example, approximately 1 second remaining of the crust breaking cycle, piston 26 contacts conductive biasing member 95 of first electrical contact device 92, which closes a circuit and sends a piston at piston first contact position signal to controller 96. Piston 26 continues displacement in piston return direction "B" until piston 26 contacts first cylinder head 32 of cylinder 30. As previously described, control valve second pressure line 90 is vented to atmosphere at this position, causing air pressure from fourth pressure source 80 to realign second control valve 42 to thereafter isolate air pressure in first pressure source 44 from first portion 28*a* of piston chamber 28, at which time, for example, approximately 8 psi of air pressure is trapped in first portion 28*a* of piston chamber 28 to retain piston 26 at the piston first stop position. Timer 98 continues to count down to zero in the example provided and the crust breaking cycle ends.

Figure 14:
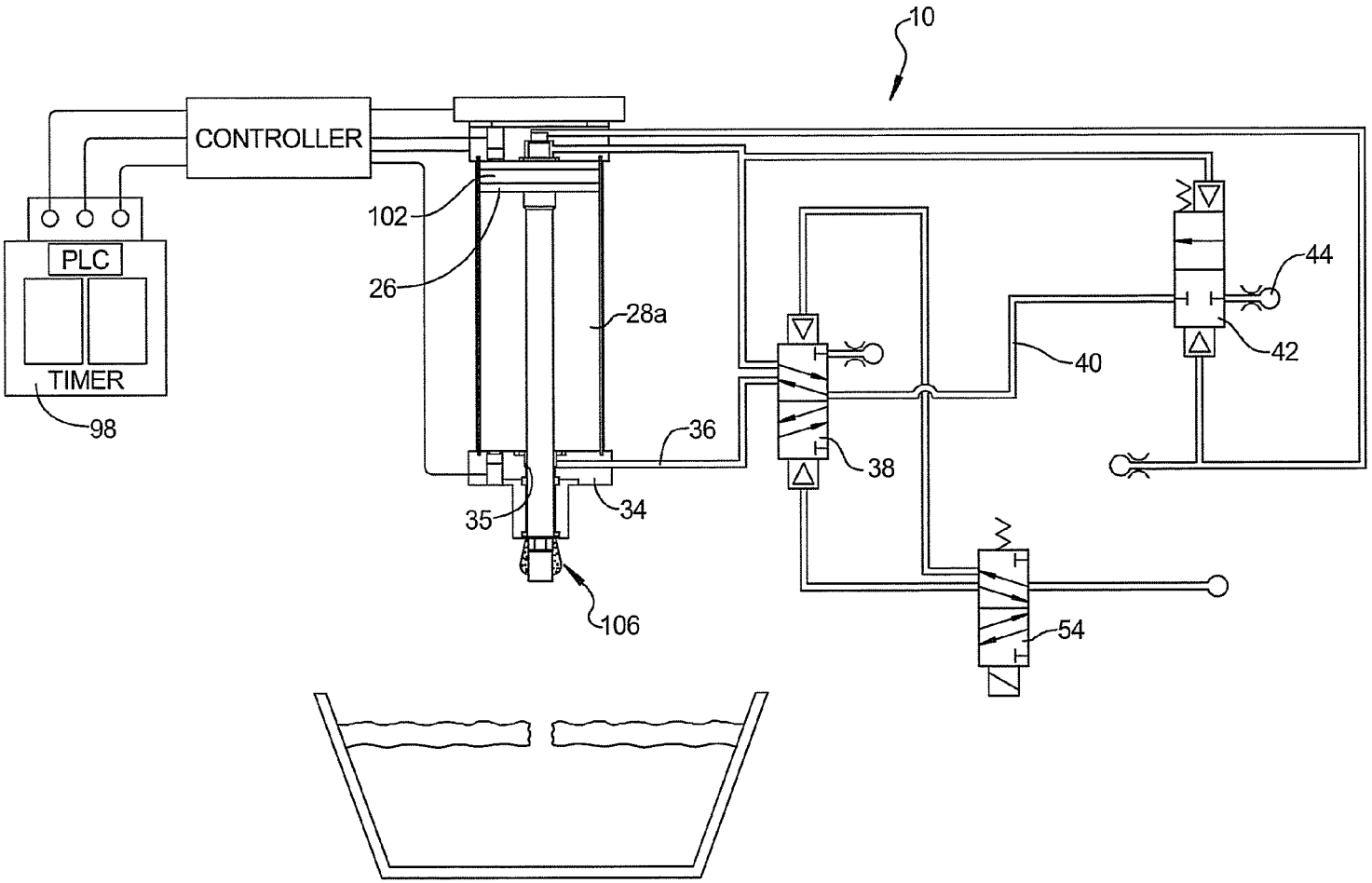
FIG. 14 is a diagram modified from FIG. 1 presenting the start of a rod seal leak event.

Referring to FIG. 14, pneumatic operating system 10 is configured with solenoid operated valve 54 and first and second control valves 38, 42 aligned as shown to minimize air pressure volume lost if a seal leak occurs. As previously noted, with piston 26 positioned at the piston first stop position, a small amount of pressurized air, for example, approximately 8 psi should be present in first portion 28*a* of piston chamber 28. Pressurized air is retained in first portion 28*a* between a first seal created by bearing/seal 35 and a second seal created by conductive piston seal 102. If a leak develops at bearing/seal 35, air will begin to leak out of both first portion 28*a* and first air supply/vent line 36 past second cylinder head 34 via a leak path 106. As also previously noted, at the piston first stop position, second control valve 42 is positioned to isolate pressurized air in first pressure source 44 from first air pressure line 40, therefore a leaking bearing/seal 35 will not immediately draw pressurized air from first pressure source 44.

Figure 15:
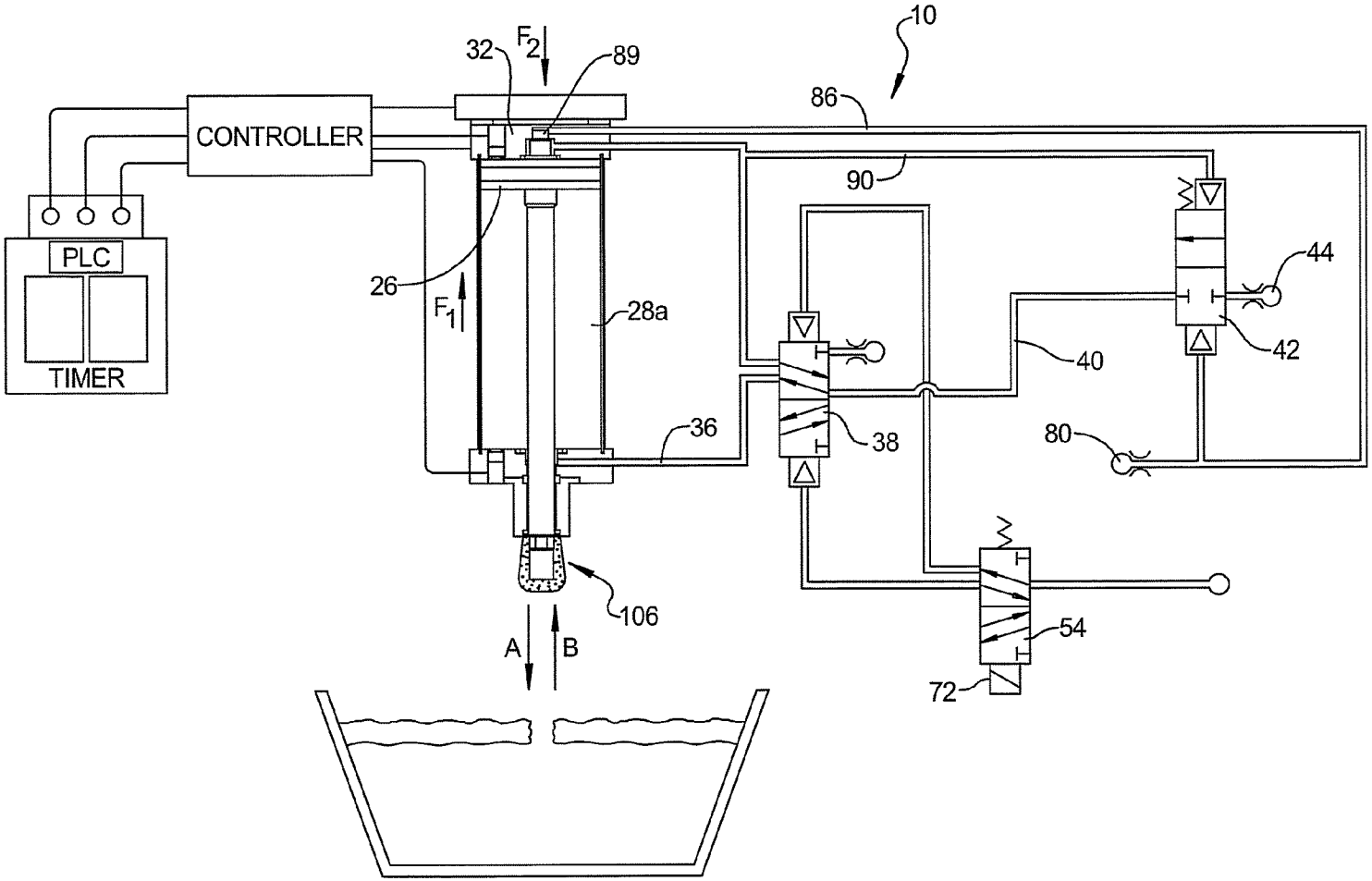
FIG. 15 is a diagram modified from FIG. 14 to show a system low pressure condition during the rod seal leak event.

Referring to FIG. 15, with continued depletion of air pressure from first portion 28*a* via leak path 106, as the air pressure in first portion 28*a* approaches, for example, approximately 2 psi, the force $F_1$ of the air pressure acting on piston 26 in the piston return direction "B" is exceeded by the oppositely directed second force $F_2$ acting in the piston drive direction "A". The second force $F_2$ results from the air pressure of fourth pressure source 80 which acts on rod extending portion or member 89 via pressure transfer line 86. When the second force $F_2$ exceeds first force $F_1$ piston 26 displaces in the piston drive direction "A" and away from first cylinder head 32 and away from the piston first stop position. At this time, air pressure line 40 remains isolated from first pressure source 44 and solenoid 72 is de-energized.

Figure 16:
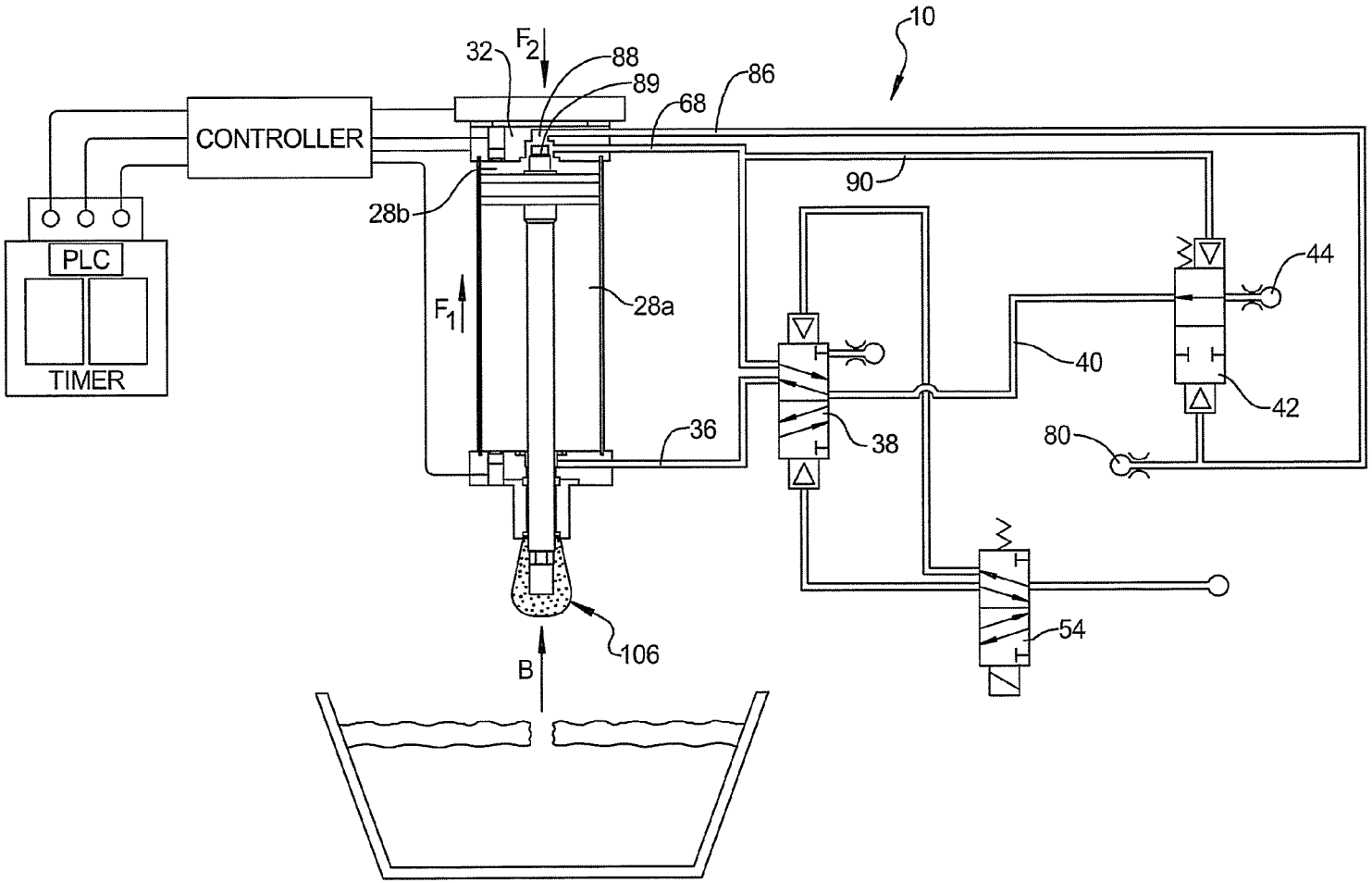
FIG. 16 is a diagram modified from FIG. 15 to show realignment of system control valves during the rod seal leak event.

Referring to FIG. 16, as piston 26 displaces in the piston drive direction "A" due to air pressure provided by fourth pressure source 80, rod extending member 89 moves out of a rod cavity 88 of first cylinder head 32. Pressurized air entering rod cavity 88 can therefore enter control valve second pressure line 90 via second air supply/vent line 36. Pressurized air entering control valve second pressure line 90 repositions second control valve 42. As second control valve 42 is repositioned, pressurized air from first pressure source 44 is once again aligned through first air pressure line 40, first control valve 38 and first air supply/vent line 36 to direct pressurized air into first portion 28*a* of piston chamber 28. When first force $F_1$ once again exceeds second force $F_2$, piston 26 will return in the piston return direction "B".

Figure 17:
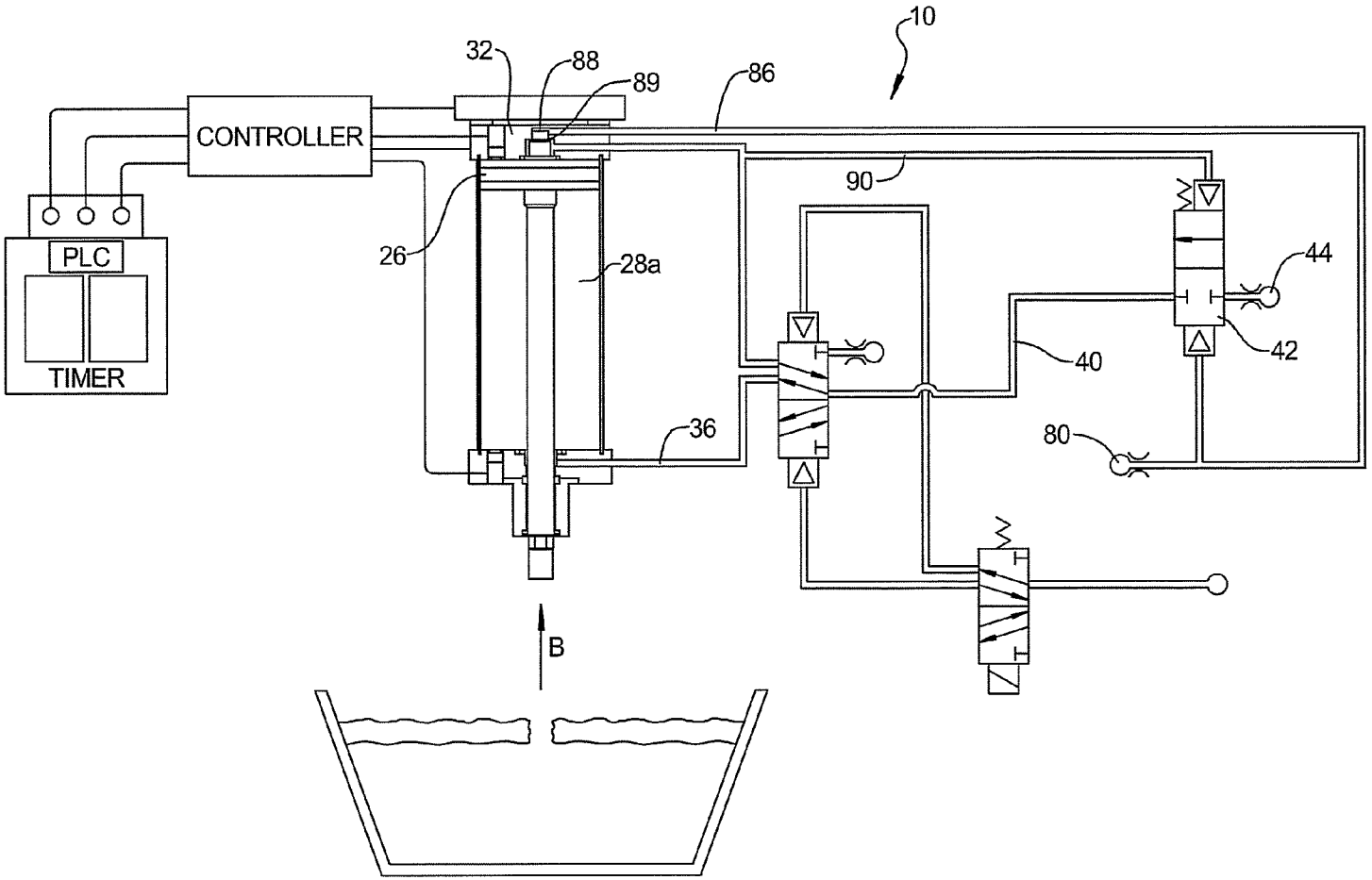
FIG. 17 is a diagram modified from FIG. 16 to show realignment of a second control valve during the rod seal leak event.

Referring to FIG. 17, piston 26 returns in the piston return direction "B" until once again reaching the piston first stop position, wherein rod extending member 89 re-enters rod cavity 88 and isolates air pressure from fourth pressure source 80 from control valve second pressure line 90. Second control valve 42 will realign to the position blocking pressurized air of first pressure source 44 from first air pressure line 40. If bearing/seal 35 continues to leak, the cycle of operation described in reference to FIGS. 14-17 will repeat until corrective action is taken, however, the volume of pressurized air lost is minimized during this event using the design of pneumatic operating system 10, whereby the rod 14 is prevented from falling into the pot and obstructing the aperture created for feeding alumina to the bath.

Figure 18:
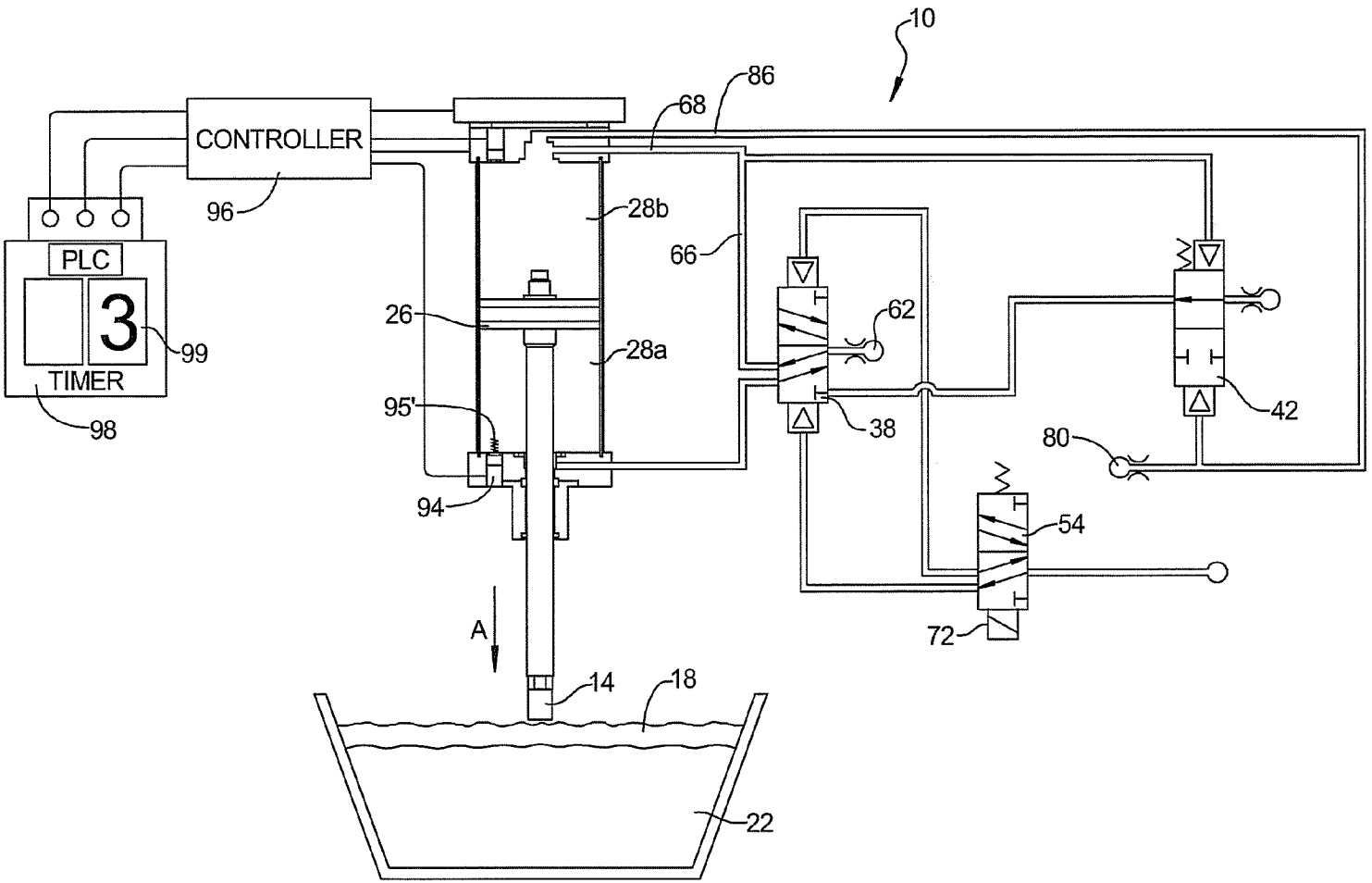
FIG. 18 is a diagram modified from FIG. 8 to show system conditions after the crust breaker bar contacts but does not penetrate a crust layer of the bath defining a hard crust event.

Referring to FIG. 18, pneumatic operating system 10 is further configured to alert the system operator of a hard crust condition, occurring when the crust breaker rod 14 is unable to penetrate crust layer 18 and/or enter melt bath 22. When a hard crust condition is encountered, crust breaker rod 14 does not enter melt bath 22 and detect the bath voltage V. In the example provided, approximately 1 second has elapsed to this point in the cycle, and indicator symbol 99 indicates approximately 3 seconds remain in the cycle governed by timer 98. Second electrical contact device 94 cannot close because piston 26 does not contact biasing member 95 of second electrical contact device 94. Timer 98 is therefore used to time-out the crust breaking cycle. Because controller 96 does not receive a signal from bath voltage V or from second electrical contact device 94, crust breaker rod 14 will remain in contact with crust layer 18 until the crust breaking cycle is timed-out. Pressure in second portion 28*b* of piston chamber 28 can therefore increase to a maximum pressure of third pressure source 62 via air delivery/vent line 66 and second air supply/vent line 36, and/or from fourth pressure source 80 via pressure transfer line 86. The maximum pressure of third pressure source 62 is therefore available to break crust layer 18.

Figure 19:
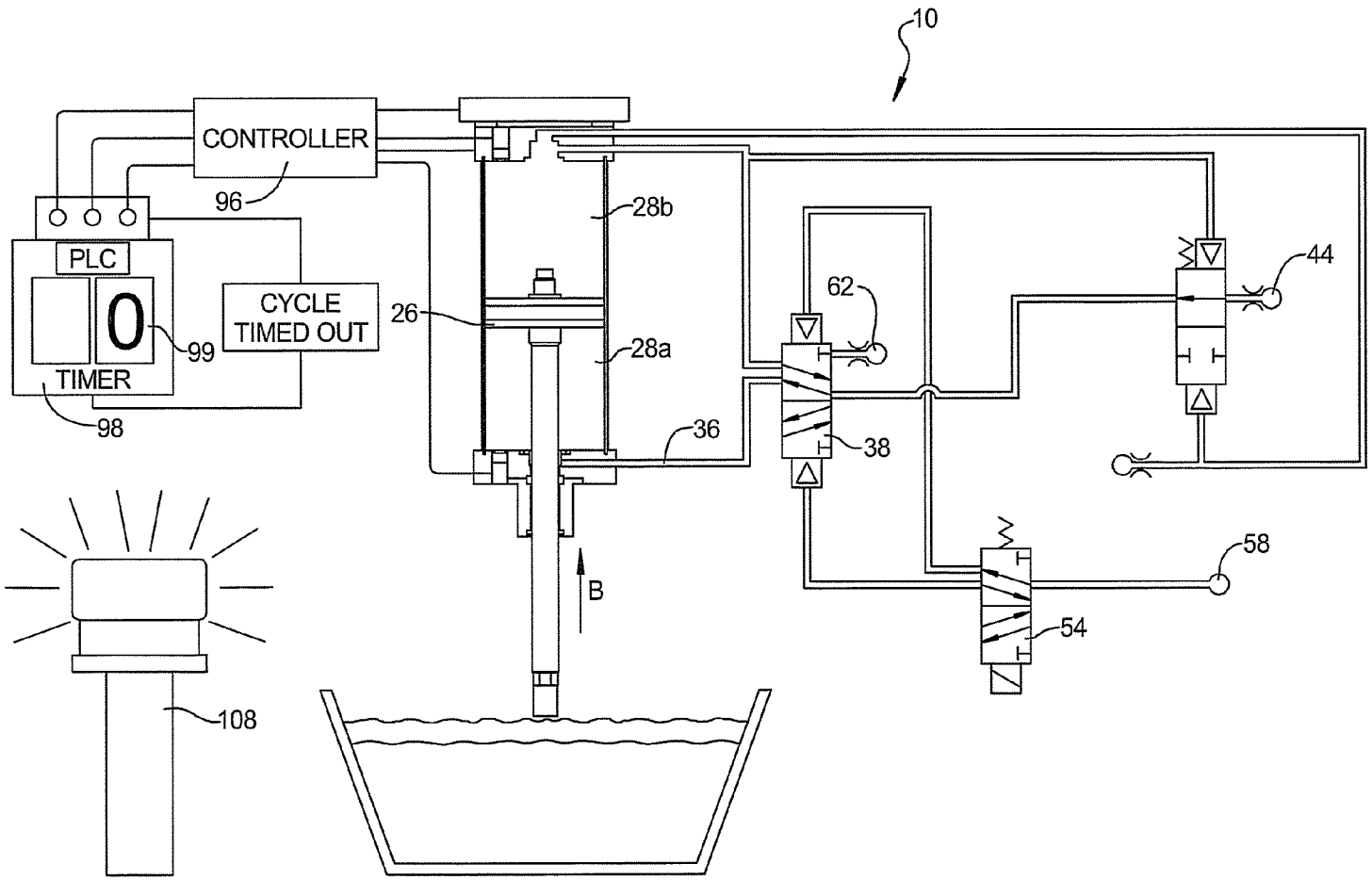
FIG. 19 is a diagram modified from FIG. 18 to show realignment of system control valves to correct from the hard crust event.

Referring to FIG. 19, timer 98 continues to count down until indicator symbol 99 reaches zero, at which time because no circuit has closed indicating either a bath voltage detection has occurred or no bath voltage detection has occurred, controller 96 directs solenoid 72 to de-energize. First control valve 38 is repositioned as previously described using pressurized air from second pressure source 58 such that third pressure source 62 is once again isolated from second portion 28*b* of piston chamber 28. First pressure source 44 is once again aligned with first portion 28*a* and the air pressure in first portion 28*a* increases to approximately 25 psi thereby force-venting second portion 28*b*, as piston 26 begins to move in the piston return direction "B". When the crust breaking cycle times-out to zero, an operator alert device 108 is triggered on by controller 96 to visually and/or audibly warn the system operator that the crust layer 18 was not broken and therefore aluminum material cannot be fed to melt bath 22.

Figure 20:
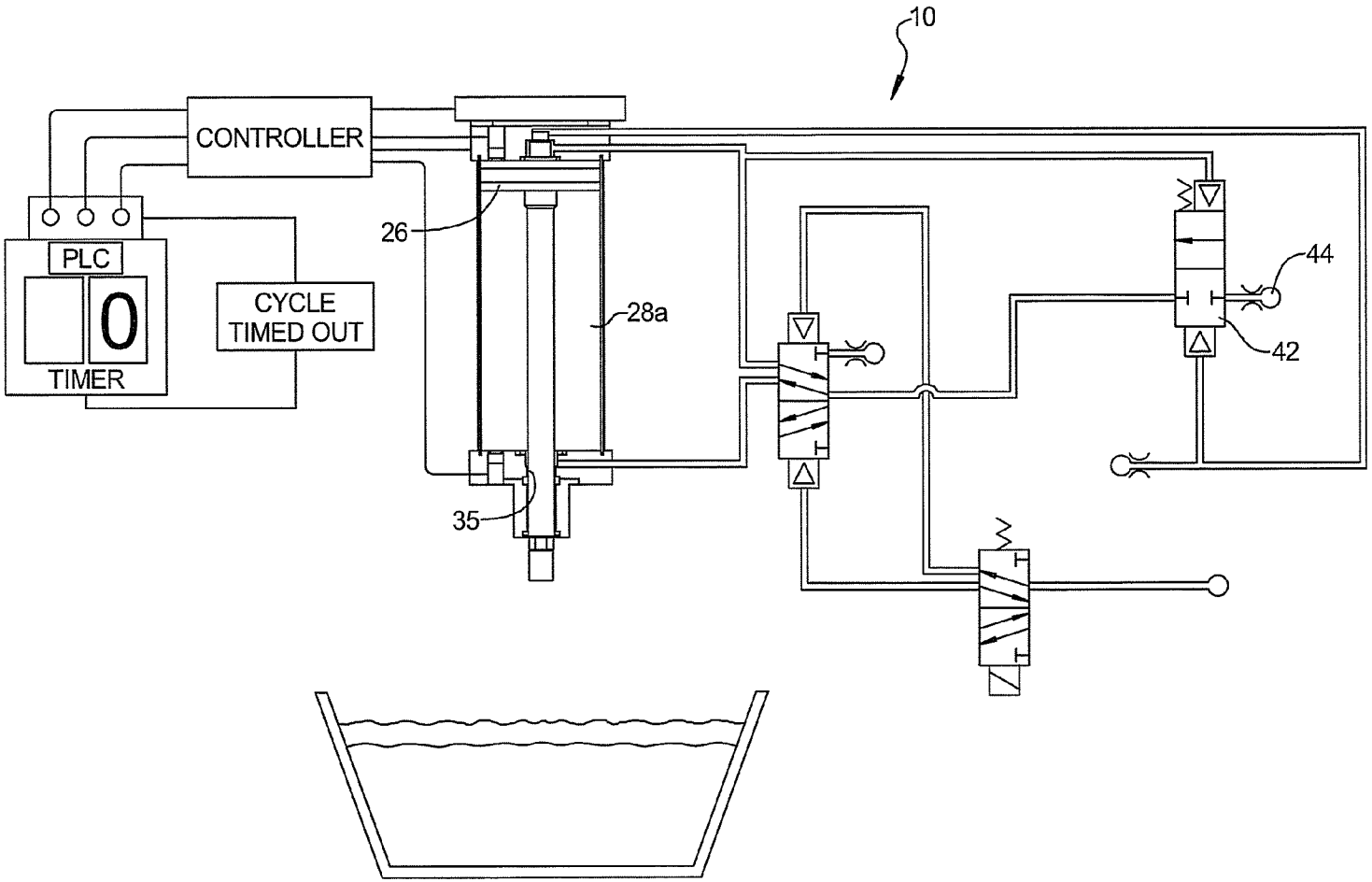
FIG. 20 is a diagram modified from FIG. 14 to show system conditions at the end of the hard crust event.

Referring to FIG. 20, when piston 26 returns to the piston first contact position with solenoid 72 de-energized, the air pressure in first portion 28*a* is approximately 25 psi. Second control valve 42 is repositioned to isolate pressurized air of first pressure source 44 from first portion 28*a*.

Figure 21:
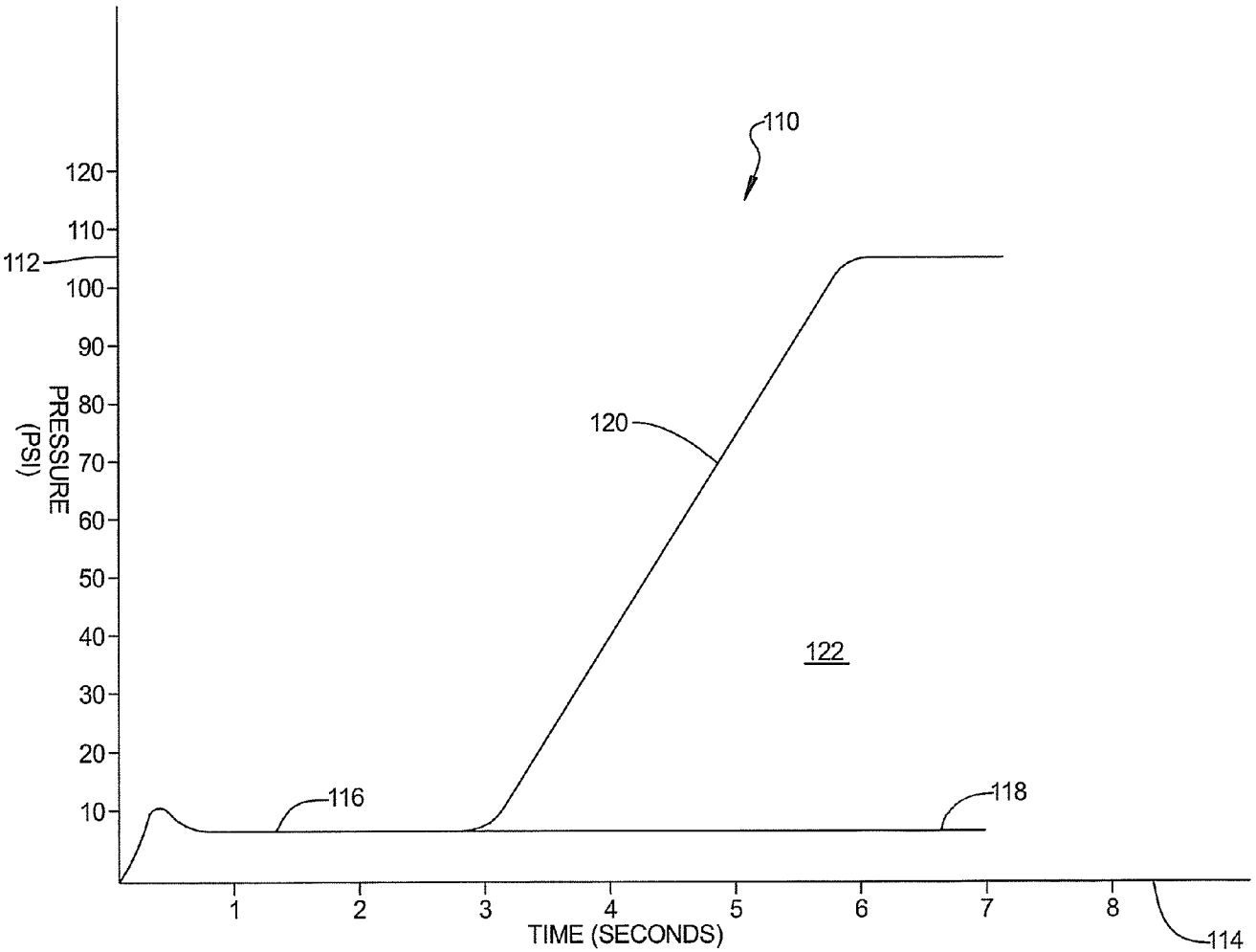
FIG. 21 is a graph of pressure versus time for the pneumatic system of the present disclosure compared to a standard operating system.

Referring to FIG. 21 and again to FIGS. 1 and 5, a graph 110 depicts a system pressure axis 112 and a time axis 114. A pressure/time curve 116 identifies a pressure in piston chamber 28, for example in first portion 28*a* as piston 26 is displaced from the bath detection position shown in FIG. 5 back to the piston first contact position shown in FIG. 1 for a time period of a typical operating cycle during a crust breaking operation. A curve portion 118 is substantially horizontal representing the end of the operating cycle, as pressure in first portion 28*a* reaches, for example, approximately 8 psi and remains at this pressure. A curve portion 120 represents a continuously building pressure in first portion 28*a* if the valve arrangement and controls of pneumatic operating system 10 are not used. Curve portion 120 indicates pressure in first portion 28*a* will continue to rise to the highest pressure of first pressure source 44, which according to several embodiments or examples is approximately 100 psi. An area 122 under curve portion 120 and above curve portion 118 represents the reduction in system pressure achieved through the use of pneumatic operating system 10. An air volume savings of approximately 10% is achieved by trapping pressurized air in first portion 28*a* at a limited pressure of, for example, approximately 8 psi compared to allowing first portion 28*a* to pressurize to the full pressure (100 psi) of first pressure source 44. In this manner, pneumatic operating system 10 carries out its cyclical crust breaking function by substantially using only as much air pressure (and, thus, air) as is necessary to complete each of its component cycle functions.

A pneumatic operating system of the present disclosure offers several advantages. Through the use of selectively sized and numbered orifices, the use of control valves, and the use of bath detection, the pressure applied to operate piston 26 can be reduced from the maximum pressure of the various pressure sources to a minimum pressure necessary to displace piston 26 in either a return or a displacement direction, a minimum pressure necessary to hold piston 26 at a piston first contact position at the first cylinder head 32, or to use the maximum available pressure of the pressure sources when necessary in breaking through the crust layer of the bath. This results in a substantial (approximately 80% or greater) savings in the volume of compressed air required to operate the pneumatic operating system 10 compared to systems which apply the full, or significantly higher, pressure source pressure for all piston displacements. The air volume savings is multiplied by each bath of a multiple bath operation known in the industry. Air volume savings also reduces related system costs, including but not limited to power consumption for air pumps, quantity and cost of air compressors required, size and cost of air pressure storage flasks, and the number of cycles of operation of the pumps and compressors which effect maintenance costs.

Operating pressure acting on piston 26 can also automatically vary, and therefore result in air savings, by continued flow through one or more of the orifices anywhere between the minimum system pressure and the maximum source pressure when necessary to overcome friction prior to initial displacement of the piston or overall resistance or friction due to components such as bearings and seals. The capability of first control valve 38 to control the direction of air flow into piston chamber 28 and/or to rapidly (for example, in approximately 2 seconds or less) vent the first or second portion 28*a* or 28*b* to atmosphere reduces the operating time for a crust breaking operation and thereby reduces air consumption.

With continuing reference to FIG. 1, according to several embodiments, exemplary control and solenoid operated valves of the present disclosure can be those manufactured by Mac Valves, Inc., of Wixom, Mich. First control valve 38 can be a Mac Valves No. 6622 valve configured to have two inlets and one exhaust. The single exhaust can have an exemplary diameter of 0.75 inches or more. Second control valve 44 can be a Mac Valves Series 53 valve. Solenoid operated valve 54 can be a Mac Valves Series 45 valve. The orifice sizes of first, second and third orifices 46, 64, 84 can vary, however, second orifice 64 is preferably larger than first orifice 46, and first orifice 46 is preferably larger than third orifice 84. Second orifice 64 is sized to minimize a time required to pressurize second portion 28*b* of piston chamber 28 to provide the force necessary to break crust layer 18. A size of first orifice 46 can be smaller than the size of second orifice 64 because pressure in first portion 28*a* during the return stroke of piston 24 is minimized as it is not required to also provide crust breaking force. Examples of exemplary orifices can be approximately 0.156 inches diameter for first orifice 46 and 0.28 inches diameter for second orifice 64 and 0.032 inches diameter for third orifice 84.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A pneumatic system for controlling a bath crust breaker, comprising:

a cylinder defining a piston chamber;

a piston slidably displaced within the cylinder by a pressurized fluid directed to either a first portion of the piston chamber with respect to the piston or a second portion of the piston chamber oppositely positioned about the piston with respect to the first portion; and a pneumatic valve system, including:

a first control valve positioned between a first pressure limiting orifice and the piston chamber, the first control valve being aligned between first control valve first and second positions, wherein the first control valve in the first control valve first position is aligned with the first portion, and in the first control valve second position is aligned with the second portion; and a second control valve positioned between a second pressure limiting orifice and the first control valve, the second control valve being aligned between second control valve first and second positions.

2. The pneumatic system for controlling a bath crust breaker of claim 1, further including a first pressure source aligned with the first portion when the first control valve is in the first control valve first position and the second control valve is in the second control valve second position, wherein the second pressure limiting orifice is positioned between the first pressure source and the second control valve.

3. The pneumatic system for controlling a bath crust breaker of claim 2, further including a first pressure source providing pressurized fluid to the first pressure limiting orifice, and a second pressure source providing pressurized fluid to the second pressure limiting orifice.

4. The pneumatic system for controlling a bath crust breaker of claim 2, further including a solenoid operated valve aligned between solenoid operated valve first and second positions and a second pressure source aligned to move the first control valve to the first control valve first position with the solenoid operated valve in the solenoid operated valve first position, the second pressure source aligned to move the first control valve to the first control valve second position with the solenoid operated valve in the solenoid operated valve second position.

5. The pneumatic system for controlling a bath crust breaker of claim 4, further including a third pressure source aligned with the second portion when the first control valve is in the first control valve second position and when the second control valve is in the second control valve second position, wherein the first pressure limiting orifice is positioned between the third pressure source and the first control valve.

6. The pneumatic system for controlling a bath crust breaker of claim 2, further including a first pressure source wherein pressurized fluid from the first pressure source is trapped in the first portion of the piston chamber when the first control valve is in the first control valve first position and the second control valve is in the second control valve first position.

7. The pneumatic system for controlling a bath crust breaker of claim 1, further including:

a solenoid operated valve moved between a solenoid operated valve first position directing pressurized fluid to a first control valve port of the first control valve, and a solenoid operated valve second position directing pressurized fluid to a second control valve port of the first control valve; and a solenoid energized to move the solenoid operated valve from the solenoid operated valve first position to the second position.

8. The pneumatic system for controlling a bath crust breaker of claim 7, further including a pressure source aligned by the solenoid operated valve in the solenoid operated valve first position to position the first control valve in the first control valve first position, and aligned by the solenoid operated valve in the solenoid operated valve second position to position the first control valve in the first control valve second position.

9. The pneumatic system for controlling a bath crust breaker of claim 7, further including a controller in electrical communication with the cylinder and operating to signal the solenoid to either energize or de-energize.

10. The pneumatic system for controlling a bath crust breaker of claim 9, further including a timer in communication with the controller, the timer providing a selectable cycle time for displacement of the piston from a piston first contact position, to a piston second contact position, and return of the piston to the piston first contact position.

11. The pneumatic system for controlling a bath crust breaker of claim 1, further including a first portion directed pressure source aligned to the first portion when the first control valve is in the first control valve first position and the second control valve is in the second control first position.

12. The pneumatic system for controlling a bath crust breaker of claim 1, further including a second portion directed pressure source aligned to the second portion when the first control valve is in the first control valve second position which also isolates a first air pressure line connected between the first and second control valves from the first portion in both the second control valve first and second positions.

13. The pneumatic system for controlling a bath crust breaker of claim 1, further including a crust breaker rod connected to the piston and displaced into a bath when the piston is displaced in the cylinder in a piston drive direction.

14. A pneumatic system for controlling a bath crust breaker, comprising:

a cylinder defining a piston chamber;

a piston slidably displaced within the cylinder by a pressurized fluid;

a crust breaker rod connected to the piston displaced into a bath by displacement of the piston; and a pneumatic valve system, including:

a first control valve moved between first control valve first and second positions, the first control valve in the first control valve first position aligned to pressurize a first portion of the piston chamber, and in the first control valve second position aligned to pressurize a second portion of the piston chamber;

an orifice positioned between a pressure source and the first control valve sized to control a pressurized fluid flow rate per unit time such that a pressure reached in either the first or second portion during a crust breaking cycle is less than a maximum pressure of the pressure source; and a second control valve moved between second control valve first and second positions, the second control valve in the second control valve first position aligned with a pressure source and the first control valve to pressurize the first portion of the piston chamber, and in the second control valve second position is aligned to isolate the pressure source from both the first control valve and the first portion.

15. The pneumatic system for controlling a bath crust breaker of claim 14, further including:

a rod cavity created in a first cylinder head of the cylinder; and a piston rod connected to the piston having a piston rod extending member slidably received in the rod cavity when the piston is in direct contact with the first cylinder head defining a piston first contact position.

16. The pneumatic system for controlling a bath crust breaker of claim 15, further including:

a pressure transfer line connected to a first control valve port of the second control valve and to the rod cavity;

a control valve second pressure line connected to the rod cavity and a second control valve port of the second control valve; and a pressure source in communication with both the pressure transfer line and the control valve second pressure line when the piston rod extending member extends freely away from the rod cavity, pressurized air from the pressure source acting to reposition the second control valve.

17. The pneumatic system for controlling a bath crust breaker of claim 14, wherein the second portion of the piston chamber is oppositely positioned about the piston with respect to the first portion.

18. The pneumatic system for controlling a bath crust breaker of claim 17, wherein:

the cylinder includes a cylinder head, the piston positioned in contact with the cylinder head at a piston first contact position at the start of a crust breaking cycle; and the piston is displaced in a piston drive direction when the pressurized fluid is directed into the second portion; and the piston is returned to the piston first contact position defining an end of the crust breaking cycle when the pressurized fluid is directed into the first portion.

19. A pneumatic system for controlling a bath crust breaker, comprising:

a cylinder defining a piston chamber;

a piston slidably displaced within the cylinder by a pressurized fluid from a pressure source directed to either a first portion of the piston chamber with respect to the piston or a second portion of the piston chamber oppositely positioned about the piston with respect to the first portion;

a crust breaking member connected to the piston and displaced into a bath when the piston is displaced in the cylinder in a piston drive direction;

at least one control valve directing the pressurized fluid into either the first or second portion of the piston chamber; and multiple orifices each positioned in line with individual pressure sources, the orifices each sized to limit a flow rate of a pressurized fluid from the pressure source to the piston chamber such that a pressure within the first and second portions of the piston chamber is limited to less than a maximum pressure of the pressure source.

20. The pneumatic system for controlling a bath crust breaker of claim 19, wherein the crust breaking member includes a conductive crust breaker rod connected to a conductive piston rod, the piston rod connected to the piston.

21. The pneumatic system for controlling a bath crust breaker of claim 19, wherein the at least one control valve includes:

a first control valve positioned between a second portion directed pressure source of the individual pressure sources and the second portion of the piston chamber, the first control valve being aligned between first control valve first and second positions, the first control valve in the first control valve first position aligned with the first portion, and in the first control valve second position is aligned with the second portion; and a second control valve positioned between a first portion directed pressure source of the individual pressure sources and the first portion of the piston chamber, the second control valve being aligned between second control valve first and second positions.

22. The pneumatic system for controlling a bath crust breaker of claim 19, wherein the second control valve is additionally positioned between the first portion directed pressure source and the first control valve.

23. A method for controlling a bath crust breaker pneumatic system, the pneumatic system including a cylinder defining a piston chamber having a first portion and a second portion, a pressurized fluid, a crust breaker member connected to a piston, and first and second control valves each alignable to a first and second position, the method comprising:

aligning the first control valve to the first control valve second position to pressurize the second portion of the piston chamber causing the piston together with the crust breaker rod to be displaced into a bath;

during the aligning the first control valve to the second position, passing pressurized fluid flowing from a second portion directed pressure source through the first control valve and into the second portion through a first orifice to control a pressurized fluid flow rate per unit time such that a pressure reached in the second portion during a crust breaking cycle is less than a maximum pressure of the second portion directed pressure source;

aligning the second control valve to the second control valve second position to pressurize the first portion of the piston chamber causing the piston together with the crust breaker rod to be displaced away from the bath; and during the aligning the second control valve to the second position, passing pressurized fluid from a first portion directed pressure source through the second control valve and into the first portion through a second orifice to control a pressurized fluid flow rate per unit time such that a pressure reached in the first portion during the crust breaking cycle is less than a maximum pressure of the first portion directed pressure source.

24. The method of claim 23, further comprising conductively transferring a bath voltage of the bath to a controller via a conductive path comprising a conductive piston rod, a conducive piston, a conductive piston seal, and a conductive portion of the cylinder.

25. The method of claim 24, further comprising generating a signal in the controller operating to energize a solenoid of a solenoid operated valve to realign the solenoid operated valve thereby directing a flow of pressurized air to change alignment of the first control valve.

* * * * *

UNITED STATES PATENT AND TRADEMARK OFFICE

CERTIFICATE OF CORRECTION

PATENT NO. : 8,910,562 B2
APPLICATION NO. : 13/159006
DATED : December 16, 2014
INVENTOR(S) : Gilles Beaulieu It is certified that error appears in the above-identified patent and that said Letters Patent is hereby corrected as shown below:

Title Page,

Column 2, Item (57) Abstract, Line 2, Delete “slideably” and insert --slidably-- therefor In the Specification, Column 1, Summary
Line 49, Delete “slideably” and insert --slidably-- therefor
Line 63, Delete “slideably” and insert --slidably-- therefor Column 2
Line 12, Delete “slideably” and insert --slidably-- therefor
Line 29, Delete “slideably” and insert --slidably-- therefor Column 3, Detailed Description
Line 61, Delete “slideably” and insert --slidably-- therefor Column 9
Line 32, Delete “36.” and insert --68.--, therefor Column 10
Line 7, Delete “36” and insert --68--, therefor Column 11
Line 35, Delete “44” and insert --42--, therefor Signed and Sealed this
Nineteenth Day of May, 2015

Michelle K. Lee

Michelle K. Lee
*Director of the United States Patent and Trademark Office*